US012448778B2

(12) United States Patent
Iannacone, III

(10) Patent No.: US 12,448,778 B2
(45) Date of Patent: Oct. 21, 2025

(54) LUXURY VINYL PLANK STAIR NOSES AND OTHER MOLDINGS

(71) Applicant: Finished Edge Technology LLC, Tempe, AZ (US)

(72) Inventor: Charles Paul Iannacone, III, Apache Junction, AZ (US)

(73) Assignee: Finished Edge Technology LLC, Tempe, AZ (US)

( * ) Notice: Subject to any disclaimer, the term of this patent is extended or adjusted under 35 U.S.C. 154(b) by 88 days.

(21) Appl. No.: 17/934,988

(22) Filed: Sep. 23, 2022

(65) Prior Publication Data

US 2023/0020659 A1 Jan. 19, 2023

Related U.S. Application Data

(63) Continuation-in-part of application No. 17/655,898, filed on Mar. 22, 2022, which is a continuation-in-part of application No. 17/336,925, filed on Jun. 2, 2021, now Pat. No. 11,873,645.

(60) Provisional application No. 63/034,204, filed on Jun. 3, 2020.

(51) Int. Cl.
*E04F 11/16* (2006.01)
*E04F 11/17* (2006.01)

(52) U.S. Cl.
CPC ..... *E04F 11/175* (2013.01); *E04F 11/166* (2013.01)

(58) Field of Classification Search
CPC ... E04F 11/104; E04F 11/1045; E04F 11/108; E04F 11/16; E04F 11/163; E04F 11/166; E04F 11/17; E04F 11/175
USPC ..... 52/174, 179, 188, 190
See application file for complete search history.

(56) References Cited

U.S. PATENT DOCUMENTS

| | | | | |
|---|---|---|---|---|
| 3,903,663 | A | 9/1975 | Bainter et al. | |
| 4,024,684 | A * | 5/1977 | Holmgren | B21D 5/00 52/514 |
| 4,262,514 | A | 4/1981 | Howell et al. | |
| 4,783,939 | A | 11/1988 | Bergmann et al. | |
| 4,893,449 | A | 1/1990 | Kemper | |
| 5,657,598 | A | 8/1997 | Wilbs et al. | |

(Continued)

FOREIGN PATENT DOCUMENTS

| | | | |
|---|---|---|---|
| AT | 11538 U1 * | 10/2010 | E04F 11/108 |
| CA | 2837273 A1 * | 6/2014 | E04F 11/175 |

(Continued)

OTHER PUBLICATIONS

Machine Translation of AT11538; https://worldwide.espacenet.com/patent/search/family/042937718/publication/AT11538U1?q=AT11538 (Year: 2024).*

(Continued)

*Primary Examiner* — Ryan D Kwiecinski
(74) *Attorney, Agent, or Firm* — Brian M. Kaufman; Robert D. Atkins; PATENT LAW GROUP: Atkins and Associates, P.C.

(57) ABSTRACT

A molding is made from a first flooring plank. A first groove is formed into the first flooring plank with a first flat bottom surface. A second groove is formed into the first flooring plank with a second flat bottom surface. The first flooring plank is folded at the first groove and second groove. A second flooring plank is disposed adjacent to the molding. A color and pattern of the first flooring plank and second flooring plank match.

14 Claims, 29 Drawing Sheets

(56) References Cited

U.S. PATENT DOCUMENTS

| | | | | |
|---|---|---|---|---|
| 5,787,674 | A | 8/1998 | Nelson | |
| 6,446,399 | B1 | 9/2002 | Lecours | |
| 7,329,456 | B2 * | 2/2008 | Tilton | A47B 81/06 493/69 |
| 8,312,754 | B2 * | 11/2012 | Lewis | B32B 3/12 72/324 |
| 8,572,912 | B2 | 11/2013 | Neuhofer, Jr. | |
| 9,399,874 | B2 | 7/2016 | Spielman | |
| 10,883,280 | B2 | 1/2021 | Decruy et al. | |
| 11,111,676 | B2 | 9/2021 | Nedza | |
| 2001/0031336 | A1 * | 10/2001 | Born | B32B 5/18 428/167 |
| 2006/0150539 | A1 | 7/2006 | Vanhastel et al. | |
| 2006/0150565 | A1 | 7/2006 | Schacht | |
| 2008/0034696 | A1 | 2/2008 | Neuhofer | |
| 2009/0145059 | A1 | 6/2009 | Kay | |
| 2010/0218448 | A1 | 9/2010 | Schacht | |
| 2010/0242382 | A1 * | 9/2010 | Pearson | B29C 53/043 52/749.1 |
| 2011/0005159 | A1 * | 1/2011 | Lee | B32B 21/08 428/319.7 |
| 2011/0146168 | A1 | 6/2011 | van Genderen | |
| 2011/0252725 | A1 | 10/2011 | Glorgio | |
| 2013/0167464 | A1 | 7/2013 | Stanchfield | |
| 2013/0305635 | A1 * | 11/2013 | McCool | E04F 11/108 52/741.2 |
| 2014/0026500 | A1 * | 1/2014 | Spielman | E04F 11/175 52/741.2 |
| 2014/0130430 | A1 * | 5/2014 | McCool | B27M 1/08 144/353 |
| 2014/0174005 | A1 * | 6/2014 | Richard | E04F 11/175 52/741.2 |
| 2016/0010338 | A1 * | 1/2016 | Steijvers | E04F 11/175 52/741.1 |
| 2016/0222673 | A1 * | 8/2016 | Brink | E04F 11/035 |
| 2018/0135313 | A1 * | 5/2018 | Chen | B32B 27/12 |
| 2019/0032343 | A1 | 1/2019 | Decruy et al. | |
| 2019/0161975 | A1 | 5/2019 | Simon | |
| 2020/0131779 | A1 * | 4/2020 | Nedza | B32B 27/12 |
| 2021/0381244 | A1 * | 12/2021 | Iannacone, III | E04F 11/163 |
| 2022/0213690 | A1 * | 7/2022 | Iannacone, III | E04F 11/163 |
| 2023/0001604 | A1 * | 1/2023 | Cappelle | B27M 3/0026 |
| 2023/0020659 | A1 * | 1/2023 | Iannacone, III | E04F 11/166 |
| 2023/0212861 | A1 * | 7/2023 | Iannacone, III | E04F 11/17 52/179 |
| 2024/0133183 | A1 * | 4/2024 | Iannacone, III | E04F 11/1045 |

FOREIGN PATENT DOCUMENTS

| | | | | | |
|---|---|---|---|---|---|
| CN | 105332482 | A | * | 2/2016 | |
| CN | 108086608 | A | * | 5/2018 | |
| CN | 111101666 | A | * | 5/2020 | |
| CN | 114232919 | A | * | 3/2022 | |
| DE | 4310768 | C1 | * | 5/1994 | B29C 70/845 |
| DE | 102004026378 | A1 | * | 12/2005 | E04F 11/1045 |
| DE | 2020012005602 | U1 | | 11/2012 | |
| DE | 202018003793 | U1 | * | 10/2018 | B32B 21/02 |
| DE | 202023103920 | U1 | * | 9/2023 | |
| EP | 2700765 | A2 | * | 2/2014 | B29C 53/066 |
| FR | 2903132 | A1 | | 1/2008 | |
| FR | 2957373 | A1 | | 9/2011 | |
| JP | 2000179121 | A | * | 6/2000 | |
| JP | 2020117951 | A | * | 8/2020 | |
| WO | WO-0151727 | A1 | * | 7/2001 | B28B 11/003 |
| WO | 2007091138 | A1 | | 8/2007 | |
| WO | WO-2010111030 | A2 | * | 9/2010 | B29C 53/043 |
| WO | WO-2012024813 | A1 | * | 3/2012 | E04F 11/1045 |
| WO | 2016051100 | A1 | | 7/2016 | |
| WO | WO-2021099886 | A1 | * | 5/2021 | B27G 11/00 |

OTHER PUBLICATIONS

Zamma Corporation, Cap-A-Tread, https://www.zamma.com/cap-a-tread.html, downloaded Jun. 2, 2021.

* cited by examiner

LUXURY VINYL PLANK STAIR NOSES AND OTHER MOLDINGS

CLAIM OF DOMESTIC PRIORITY

The present application is a continuation-in-part of U.S. patent application Ser. No. 17/655,898, filed Mar. 22, 2022, which is a continuation-in-part of U.S. patent application Ser. No. 17/336,925, now U.S. Pat. No. 11,873,645, filed Jun. 2, 2021, which claims the benefit of U.S. Provisional Application No. 63/034,204, filed Jun. 3, 2020, which applications are incorporated herein by reference.

FIELD OF THE INVENTION

The present invention relates in general to stair noses and other moldings made from luxury vinyl plank flooring, and to methods, tools, and machines for forming the stair noses and other moldings from luxury vinyl plank flooring.

BACKGROUND OF THE INVENTION

Flooring manufacturers and installers have tried many different methods for providing custom stair noses that match the surrounding floor. Typical methods involve cutting off the existing stair nose and then installing a replacement stair nose closely matching the floor being installed, as shown in FIGS. 1*a*-1*d*. FIG. 1*a* illustrates a stair step 10 with a tread 12 and riser 14. Nose 16 is a part of tread 12 delineated with a dotted line to show where the nose will be cut off. FIG. 1B illustrates a floor plank 20 with a replacement nose 22 being installed over tread 12. Nose 22 is pretty similar to nose 16 that was already part of the underlying tread 12, but is designed to reasonably match the color and pattern of flooring being installed in an adjacent room.

FIG. 1*c* illustrates continuing to install flooring planks 30 next to nose plank 20. FIG. 1*d* shows plank 30 installed. Additional flooring planks 30 will continue to be installed next to each other to fully cover the stair tread or perhaps an entire room in the case of the top step.

One problem that occurs with replacing stair treads along with the rest of the adjacent flooring is matching the wood grain pattern and color. Even when the exact same type of wood and finish is used for both nose plank 20 and flooring plank 30, the color and pattern are usually off. All the floor planks 30 being used are usually made together at the same factory at the same time to match practically exactly. However, nose planks 20 are typically formed separately and, while they may match flooring planks 30 closely, will almost always have a noticeable difference in color and pattern due to being manufactured at a different time or even a different factory.

Luxury vinyl plank (LVP) flooring is a modern type of flooring that is susceptible to the problems of color matching stair nosing and other molding. FIG. 2*a* shows a cross-sectional view of one plank 50 of LVP flooring. LVP flooring is typically formed of a core 52, padding 54, an image layer 56, and a clearcoat finish 58 formed over the image layer. Core 52 is commonly a stone polymer or wood-plastic composite. A stone polymer core 52 is composed of calcium carbonate (limestone), polyvinyl chloride (PVC), and optionally plasticizers. Wood-plastic composite cores are similarly composed, with the addition of a wood product, such as sawdust or wood flour. A foaming agent may be added to soften the floor made with planks 50.

The desired design for the flooring is printed on image layer 56 and then attached to core 52. Image layer 56 can be a vinyl sheet or another printable substrate. Clearcoat layer 58 typically consists of anywhere from 1 to 100 layers of clearcoat or more. Usually between 10 and 25 layers of clearcoat are used. Clearcoat layer 58 protects the printed image layer 56, and plank 50 as a whole, from wear.

Luxury vinyl plank flooring is typically formed with connectors 60 around the perimeter of planks 50 so that individual planks can be clicked or snapped together with other adjacent planks to easily form a floor with proper alignment and a seamless transition between planks. FIG. 2*a* shows a connector 60*a* on one side of plank 50 and a connector 60*b* on the other side. When two pieces of LVP flooring 50*a* and 50*b* are slid together as shown in FIGS. 2*b* and 2*c*, connector 60*a* of one plank and connector 60*b* of the other plank slide into each other. A detent is commonly used to snap the connectors together, maintaining alignment and eliminating visible gaps between planks.

While LVP flooring makes installing a beautiful floor easier, LVP does not eliminate the problems of matching stair nosing to the surrounding flooring. The closest matching hardwood nosing is usually used even though the vinyl planks are printed. Achieving an exact match is very difficult. Therefore, a need exists for an improved stair nose, as well as other types of molding, that matches LVP flooring planks.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

One solution to providing stair noses that match luxury vinyl plank (LVP) flooring is to make the stair noses out of the same LVP planks that are being installed for the flooring. Using the same planks for both stair noses and the rest of the flooring means that the stair nose planks are manufactured at the same plant and under the same conditions as the rest of the flooring planks. The issues in the prior art with slight variations in manufacturing conditions resulting in slightly off colors and patterns are eliminated because stair nosing and floor planks are manufactured together.

Figure 1B:
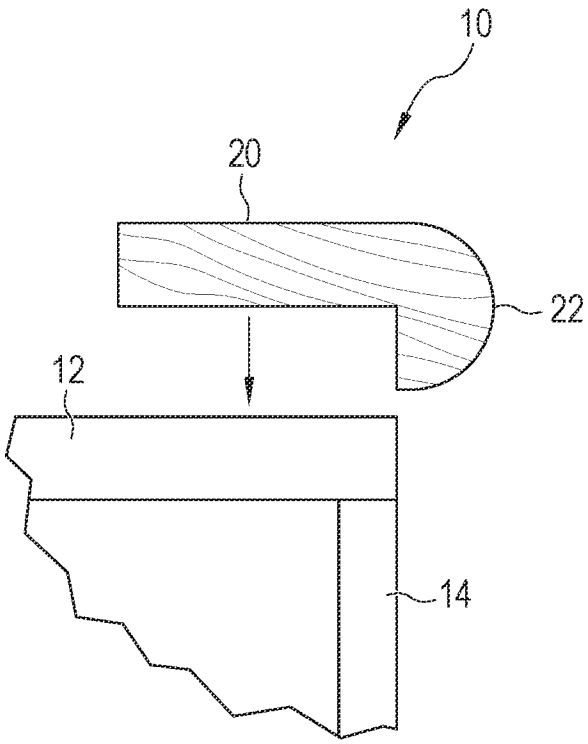
FIG. 1b (PRIOR ART)
FIGS. 1*a*-1*d* illustrate replacing a stair nose as part of installing flooring.
Figure 1A:
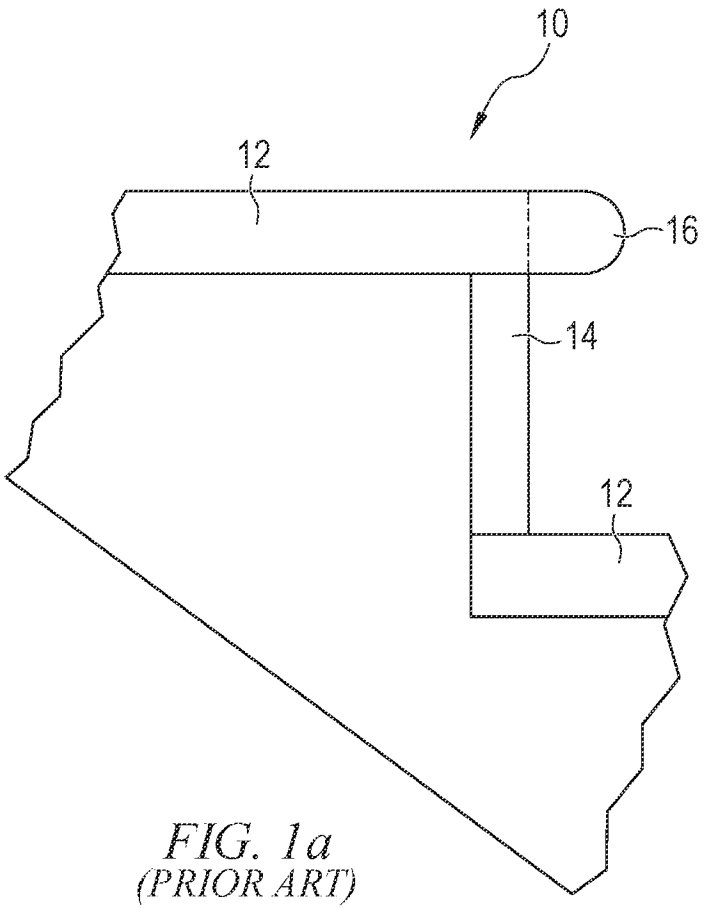
FIG. 1a (PRIOR ART)
Figure 1C:
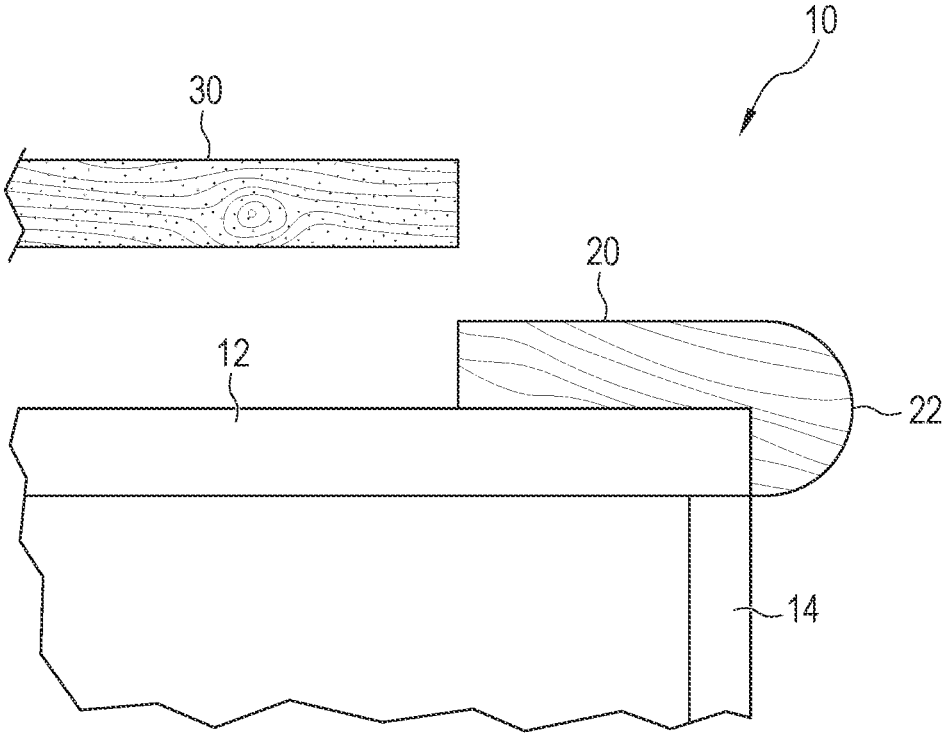
FIG. 1c (PRIOR ART)
Figure 1D:
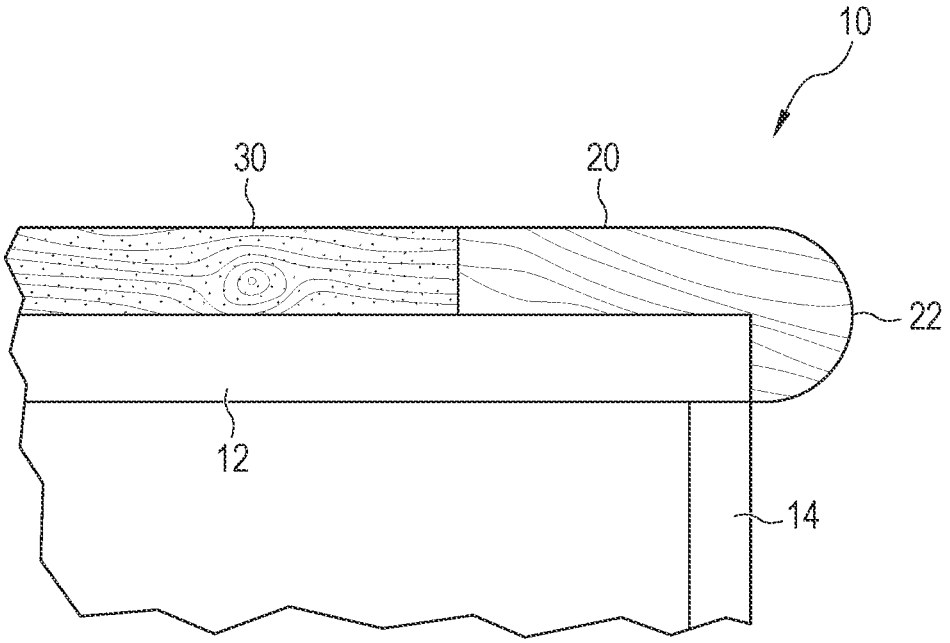
FIG. 1d (PRIOR ART)
Figure 2A:
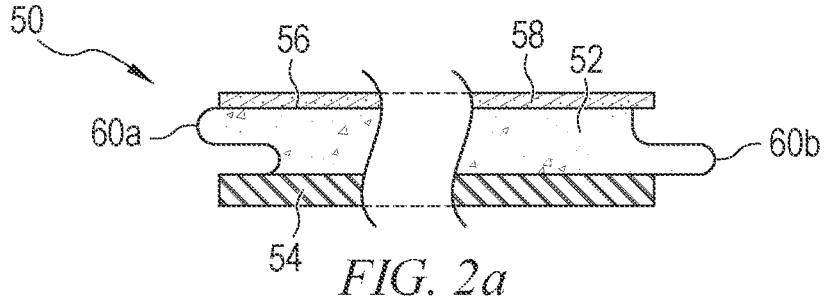
FIG. 2a (PRIOR ART)
FIGS. 2*a*-2*c* illustrate luxury vinyl plank flooring.
Figure 2B:
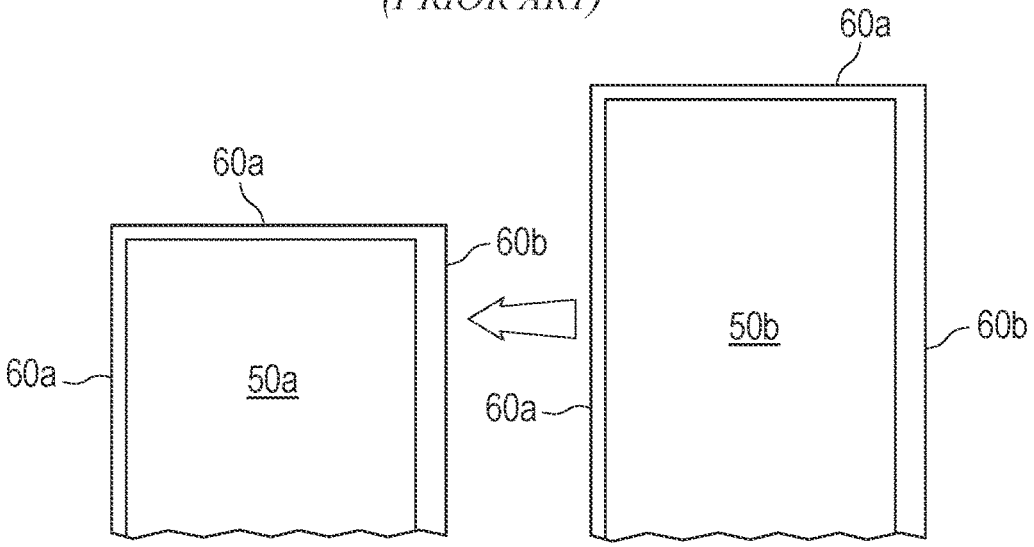
FIG. 2b (PRIOR ART)
Figure 2C:
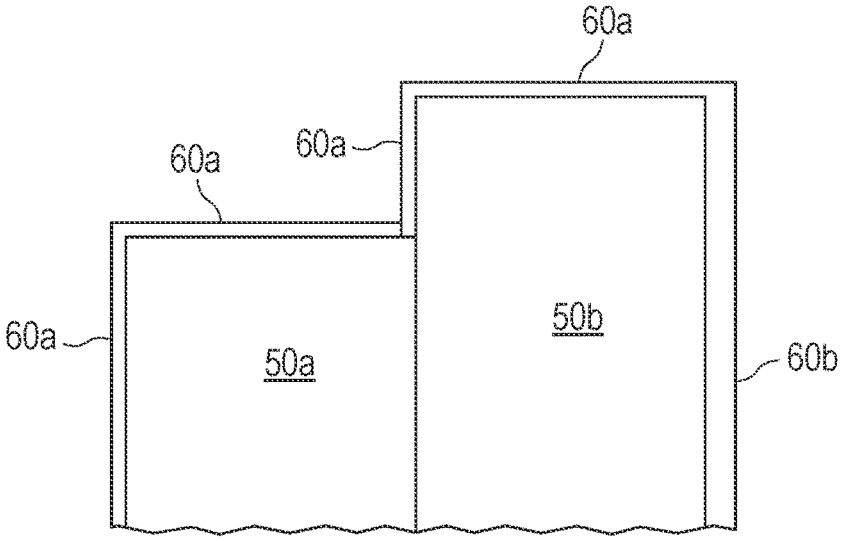
FIG. 2c (PRIOR ART)
Figure 3C:
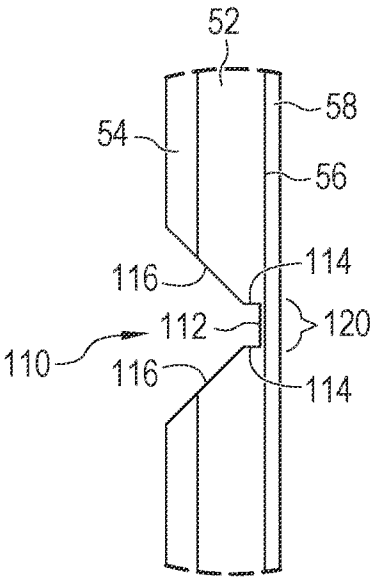
FIGS. 3*a*-3*i* illustrate cutting and folding a luxury vinyl plank to form a stair nose.
Figure 3B:
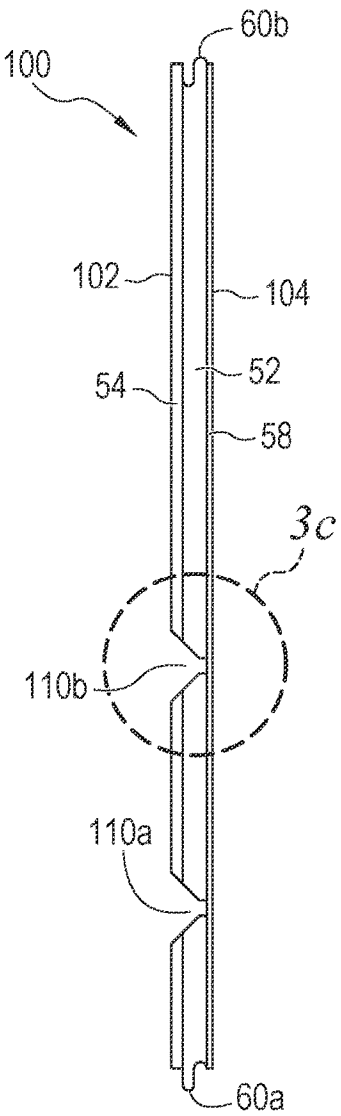
Figure 3A:
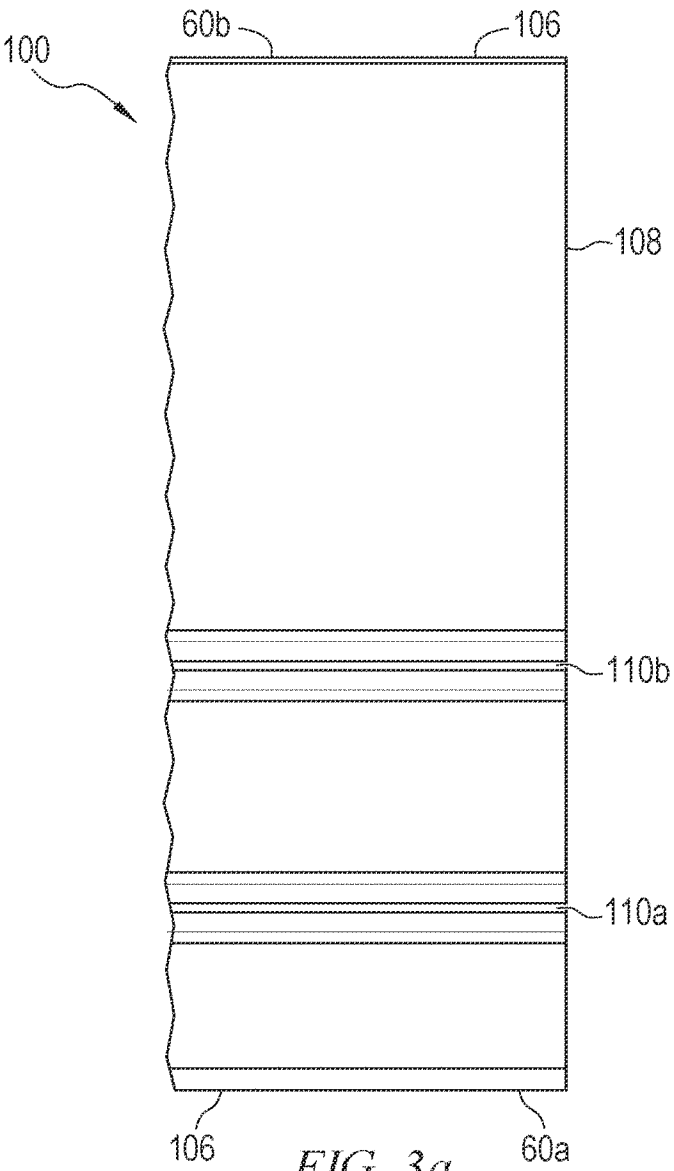

Making a stair nose out of LVP flooring involves cutting grooves into a floor plank and then folding the plank at the grooves into a stair nose shape. FIGS. 3*a* and 3*b* illustrate a floor plank 100 with a bottom surface 102 and top surface 104. Plank 100 includes two long edges 106 and two short edges 108. Plank 100 has a width extending from one long edge 106 to the other, a length extending between the two short edges 108 parallel to the long edges, and a thickness extending between top surface 104 and bottom surface 102. Planks 100 have a latching mechanism built into the edges as connectors 60*a* and 60*b*, so the opposing long edges 106 are designed to interface with each other and the opposing short edges 108 are also designed to interface with each other. A connector 60 of a short edge 108 could interface with a connector of a long edge 106 if the installer wanted to get creative. Connectors 60 are optional, and some LVP flooring planks simply have flat surfaces that are designed to contact each other when installed without latching or otherwise interfacing with each other.

Two grooves 110*a* and 110*b* are formed into bottom surface 102, but not completely through plank 100 to top surface 104. FIG. 3*c* shows additional detail of grooves 110. Grooves 110 allow plank 100 to be folded 90-degrees along each of the grooves, thus turning the plank into a stair nose. Grooves 110*a* and 110*b* are substantially identical to create two 90-degree angles along the length of plank 100. Grooves 110 each include a horizontal surface 112, two vertical surfaces 114, and two diagonal surfaces 116. Diagonal surfaces 116 connect bottom surface 102 of plank 100 to the two vertical surfaces 114. Vertical surfaces 114 connect diagonal surfaces 116 to horizontal surface 112. Horizontal surface 112 is the deepest part of grooves 110 and connects the two vertical surfaces 114 to each other. Horizontal surface 112 is considered the bottom of groove 110 due to being the deepest part of the cut.

In the illustrated embodiment, plank 100 is 8 millimeters (mm) thick, and groove 110 is formed to a depth of 7 and ⅓ mm, leaving a thin flat flexible portion 120 between horizontal surface 112 and top surface 104 with a thickness of ⅔ mm. A thickness of ½ mm is left as flexible portion 120 in other embodiments. The depth of groove 110 can be formed as close to image layer 56 as possible without damaging the image layer. Ideally core 52 would be completely removed but doing so without damaging printed layer 56 can be a challenge. Accordingly, a thin portion of core 52 is typically left under horizontal surface 112 by design. Core material 52 is flexible enough that a thin layer remaining still allows plank 100 to be folded at groove 110. In one embodiment, groove 110 is formed to leave a fixed thickness of plank 100 in flexible portion 120 so that the remaining thickness of core 52 will depend on the total thickness of image layer 56 and clearcoat layers 58.

The width of horizontal surface 112, and therefore the width of flexible portion 120 and the distance between vertical surfaces 114, is 3.2 mm. Vertical surfaces 114 have a height of 1.6 mm, and diagonal surfaces 116 each extends off at a 45-degree angle from a respective vertical surface to bottom surface 102. At bottom surface 102, diagonal surfaces 114 are approximately 0.5772 inches or 14.66 mm apart. Horizontal surface 112, vertical surfaces 114, and diagonal surfaces 116 all extend in the same profile shape for the entire length of plank 100. Any of the above measurements can be customized as needed for different plank types, compositions, sizes, etc. to ensure that diagonal surfaces 116 make proper contact when folded.

Grooves 110 with a flat horizontal surface 112 at the bottom of the grooves leaves a flat flexible portion 120 of plank 100 between horizontal surface 112 and the plank's top surface 104. Flexible portion 120 has a relatively uniform thickness for a significant width, which allows plank 100 to bend uniformly along the entire width of horizontal surface 112 when the plank is folded. Diagonal surfaces 116 could meet at a point at the bottom of the groove, but bending of plank 100 would occur over a much thinner area of plank 100 and risk tearing of image layer 56. For planks that are not as flexible, horizontal surface 112 can be made wider, allowing the plank to bend across a wider arc, or portion 120 can be made thinner to flex easier.

Each diagonal surface 116 is at a 45-degree angle so that the angle between the two diagonal surfaces is 90 degrees. When plank 100 is bent across groove 110, diagonal surfaces 116 contact each other when the plank is flexed to the same angle as exists between the diagonal surfaces. For a 90-degree bend in plank 100, diagonal surfaces 116 should make a 90-degree angle when formed. A non-symmetrical groove could be formed with, e.g., one diagonal surface 116 at a 30-degree angle and the other at a 60-degree angle, and the diagonal surfaces would still meet when plank 100 is bent to 90 degrees. Plank 100 can be folded or bent at non-right angles by varying the total angle between diagonal surfaces 116.

The height of vertical surfaces 114 in combination with the width of horizontal surface 112 controls how diagonal surfaces 116 meet when plank 100 is folded. The ideal is to have diagonal surfaces 116 lie flat on each other perfectly aligned so that the entire area of each diagonal surface is contacted by the other diagonal surface. If vertical surfaces 114 are made too short, the top edges of diagonal surfaces 116 will meet first and the diagonal surfaces will not fully touch. If vertical surfaces 114 are made too tall, the bottom edges of diagonal surfaces 116 will meet first and make full contact difficult. The above listed dimensions were found through trial and error to be optimal for most LVP flooring on the market today. However, if diagonal surfaces 116 are not meeting each other properly in practice, some dimensional adjustment might help.

Figure 3D:
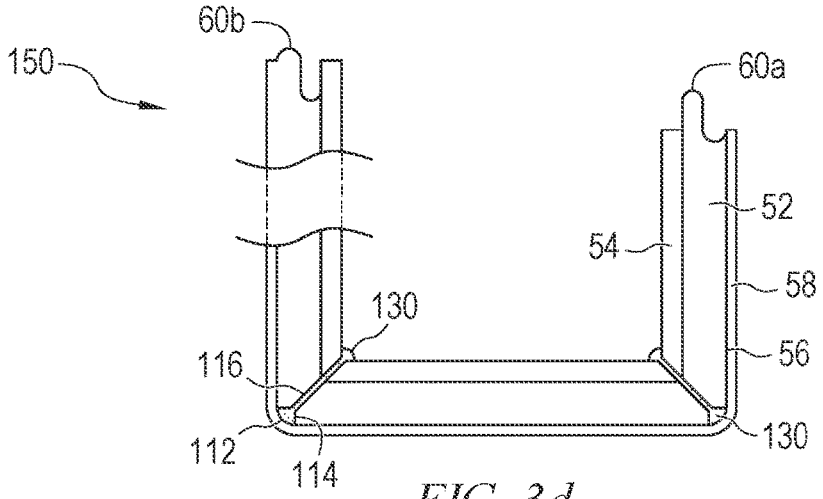

FIG. 3*d* shows plank 100 bent across both grooves 110 to 90-degree angles and glued in place so that the angles are maintained. Adhesive 130 is disposed in grooves 110 prior to folding plank 100. Diagonal surfaces 116 of each groove 110 contact each other with a thin layer of adhesive 130 between them. Vertical surfaces 114 now form a 90-degree angle, and horizontal surface 112 curves to connect the ends of vertical surfaces 114.

A gap between horizontal surface 112 and vertical surfaces 114 is shaped like an isosceles right triangle with an outwardly curved hypotenuse. The gap should be filled with adhesive 130 with as few voids as possible to maximize hold of the plank 100 folds. Thorough application of adhesive 130 can be confirmed by viewing a bead formed by the adhesive being squeezed out of groove 110 during folding.

If the bead of adhesive 130 is continuous along the length of plank 100 then the gap between horizontal surface 112 and vertical surfaces 114 is likely to be filled with adhesive. Small breaks in the bead of adhesive 130 are likely fine, but long breaks in the bead may indicate an adhesive void in groove 110 at that location.

Figure 3E:
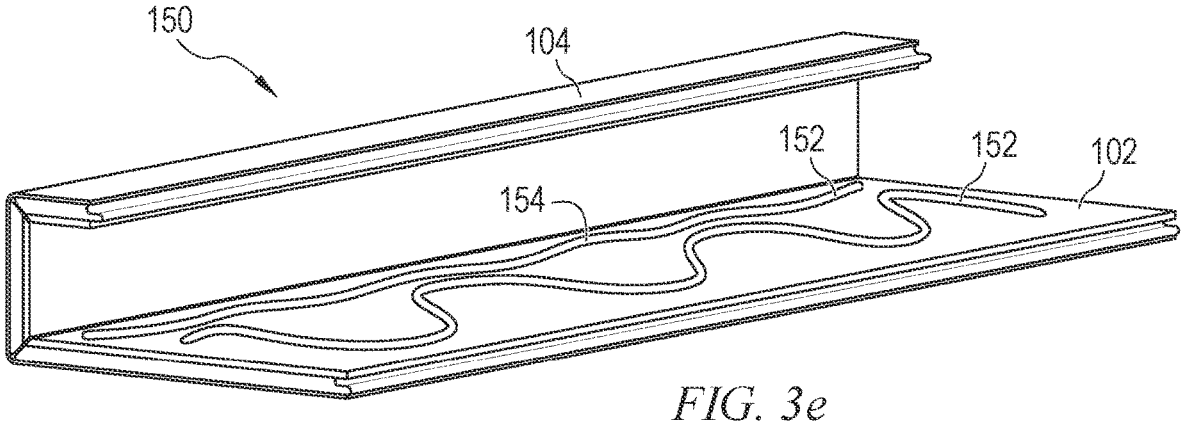

Bending and gluing both grooves 110 to 90-degree angles completes the transformation of plank 100 into a stair nose 150. Stair nose 150 is ready to be put into service on a stair step. To install stair nose 150, glue or adhesive 152 is first applied to bottom surface 102 as shown in FIG. 3*e*. Adhesive 152 can be applied directly to padding 54. Liquid nails or any type of industrial adhesive can be used. In some embodiments, planks 100 can be manufactured in two different varieties: normal planks with padding 54 for the main floor and planks without padding for stair noses. Both plank varieties are still manufactured together in the same factory to have closely matching color and pattern styles. Leaving padding 54 off planks 100 destined for being made into stair noses 150 has the added benefit that the bead of adhesive 130 that squeezes out of groove 110 sits on core 52 instead of padding 54, which provides a stronger adhesive bond.

Figure 3F:
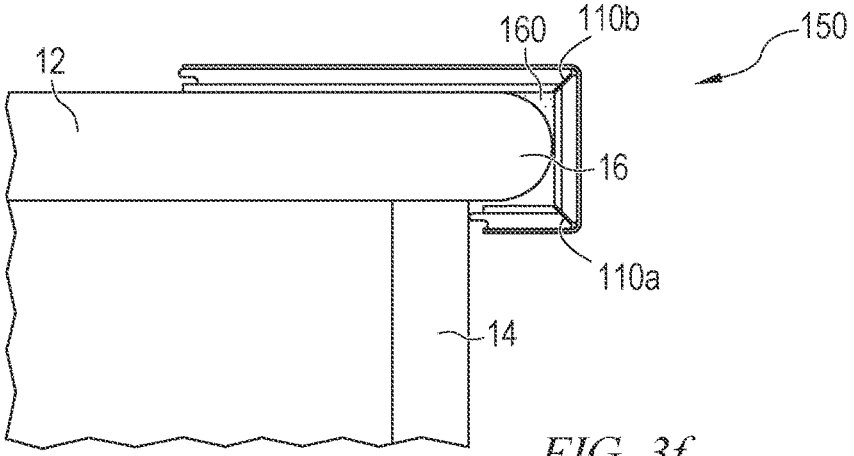

Adhesive 152 is applied to bottom surface 102 in sufficient quantity to adhere stair nose 150 to the underlying stair tread 12. In addition, a bead 154 of adhesive 152 is applied over the folded groove 110*b* so that, when stair nose 150 is installed on a stair step as shown in FIG. 3*f*, a gap 160 in the upper corner is substantially filled with adhesive. Filling gap 160 with adhesive 152 structurally supports the corner of stair nose 150 and reduces the likelihood of a heavy stepper breaking or bending the stair nose. For the best structural support, nose 16 of tread 12 should physically contact bottom surface 102 of stair nose 150 between grooves 110*a* and 110*b*. If the bottom section of stair nose 150 is too long such that riser 14 is contacted before nose 16, then the bottom end of stair nose 150 can be cut off as shown below in FIG. 3*i* to allow nose 16 to be contacted.

Figure 3G:
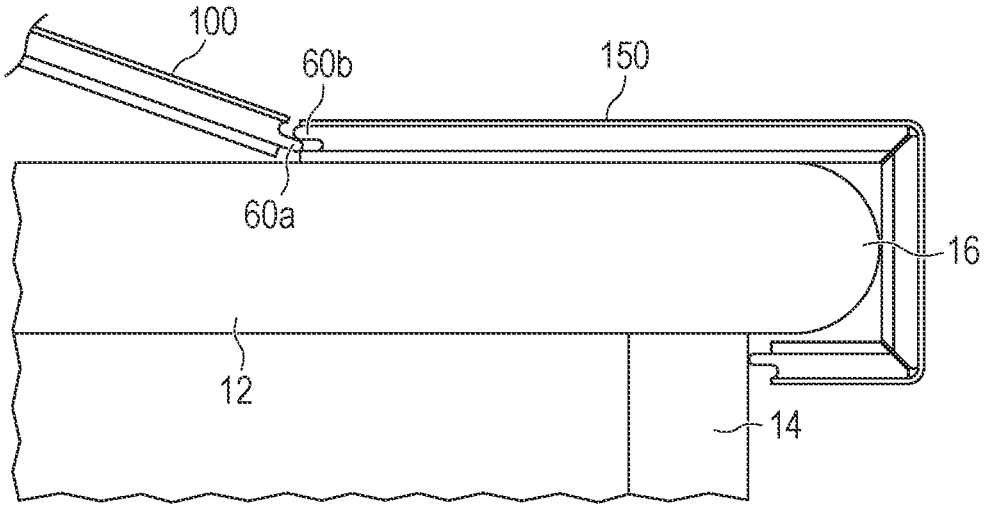
Figure 3H:
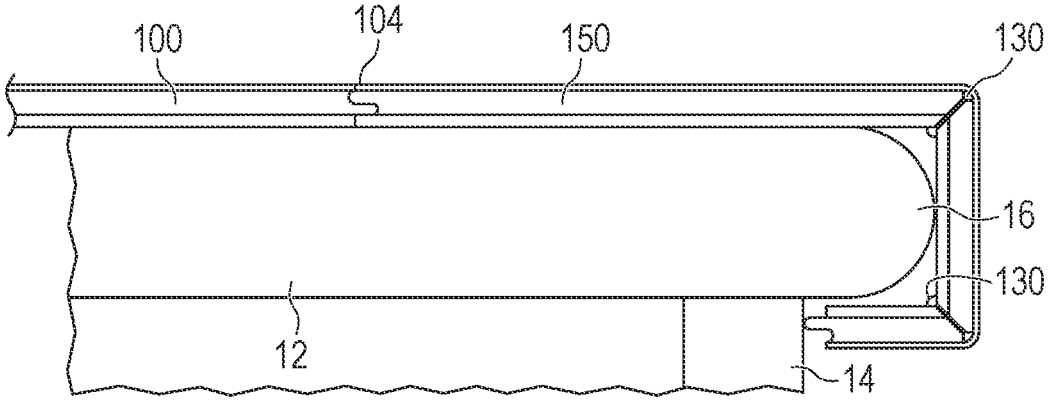

With stair nose 150 installed, additional planks 100 can be laid next to the stair nose to continue the rest of the floor as shown in FIGS. 3*g* and 3*h*. Connector 60*a* of plank 100 is interfaced with connector 60*b* of stair nose 150. As plank 100 is laid down next to stair nose 150, connectors 60 snap together and create a nearly seamless top surface 104 between the two. For an intermediate stair step, a single plank 100 may be enough to cover the stair tread. Plank 100 may be cut to size so that connector 60*b* is removed and the plank ends at or just short of the riser of the next step. For the top stair step, additional planks 100 are added until the desired floor area is covered. Both plank 100 and stair nose 150 can be cut to length appropriate for the stairs being covered. Using the same planks 100 to form stair nose 150 as well as to cover the surrounding floor area results in a uniform look with consistent color and pattern across the entirety of the floor and stairs.

Figure 3I:
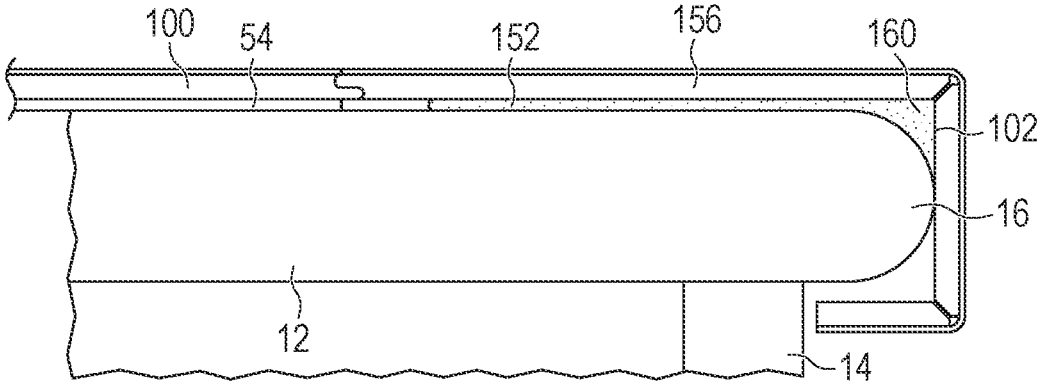

FIG. 3*i* shows a stair nose 156 made from a plank 100 without padding 54 on the bottom of the plank. Stair nose 156 is otherwise structured and manufactured the same as stair nose 150. The folded corners of stair nose 156 are stronger than those of stair nose 150 due to adhesive 130 gripping directly to core 52 without the intervening padding 54. Adhesive 152 between bottom surface 102 and tread 12 functionally and structurally replaces padding 54. Adhesive 152 fills gap 160 in the corner to structurally support stair nose 156. The bottom end of stair nose 156 is cut so that nose 16 of tread 12 contacts bottom surface 102 between the two folds. Planks 100 forming the rest of the floor adjacent to stair nose 156 are formed with padding 54, but still match properly due to being manufactured together at the same factory with the planks used to form the stair nose.

Figure 4C:
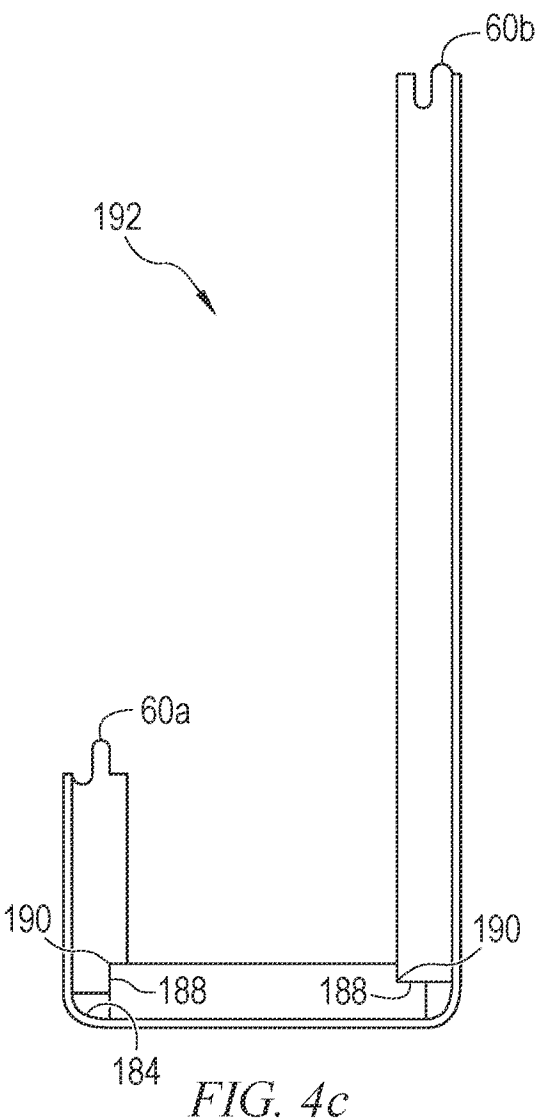
FIGS. 4*a*-4*c* illustrate an alternative groove cut profile.
Figure 4B:
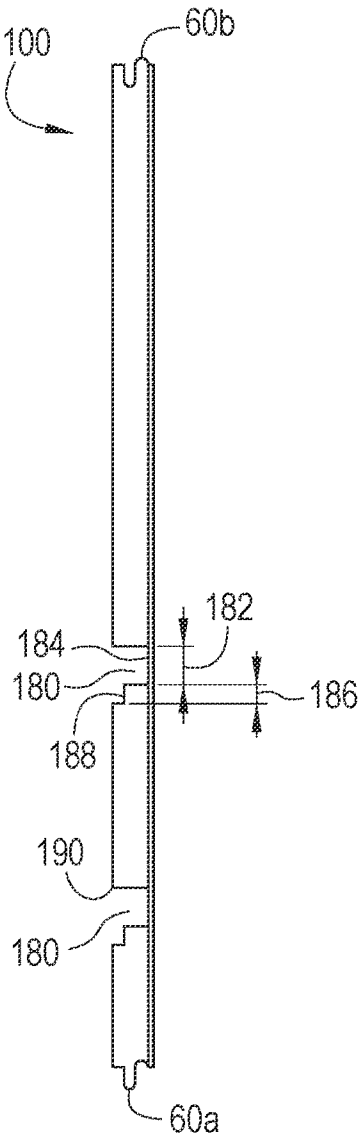
Figure 4A:
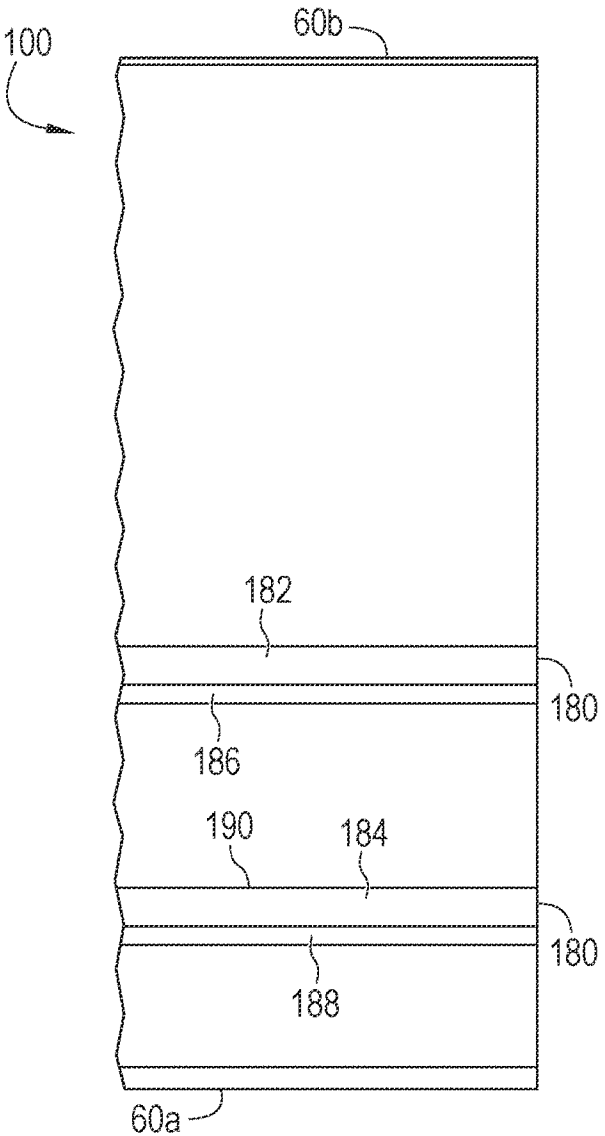

FIGS. 4*a*-4*c* show an alternative groove profile for converting plank 100 into a stair nose. FIG. 4*a* shows a plan view, FIG. 4*b* shows a cross-sectional view, and FIG. 4*c* shows plank 100 folded into stair nose 192. Grooves 180 are formed with all square cuts and no diagonal surfaces, which can make manufacturing easier due to the use of blades with perpendicular angles. Grooves 180 include a deep cut 182 to form a flexible portion 184 and a shallow cut 186 to form a shelf 188. Flexible portion 184 is a thin portion of plank 100 with a uniform thickness across a significant width, similar to flexible portion 120 above. Deep cut 182 and shallow cut 186 can be formed using a single saw blade with an appropriate profile shape or using two or more separate saw blades. Deep cut 182 forms a corner 190 opposite shelf 188.

Flexible portion 184 is similar to flexible portion 120 in groove 110, and is formed with a thickness of about ⅔ mm. Some core 52 remains in some embodiments. The width of flexible portion 184 is two to three times greater than the width of flexible portion 120 because the square cut in FIGS. 4*a* and 4*b* will have to cover a large physical distance when plank 100 is folded across groove 180. Shelf 188 is formed about 1.6 mm deep and 3.2 mm wide. The dimensions of groove 180 can be adjusted as necessary to allow plank 100 to fold properly across the groove.

FIG. 4*c* shows plank 100 folded across grooves 180 to form a stair nose molding 192. The dimensions of groove 180 are selected so that corner 190 sits on shelf 188 when plank 100 is folded to a 90-degree angle. Groove 180 is filled with adhesive prior to folding, which fills the gap remaining in deep cut 182 after folding. Shallow cut 186 is filled with the plank material from corner 190. Groove 180 provides easier manufacturing due to a simpler cut profile and creates a broader radius for the 90-degree bend, which means flooring planks that do not bend as easily can be used. The larger radius bends of grooves 180 may also be a desirable aesthetic choice for some people.

Figure 5B:
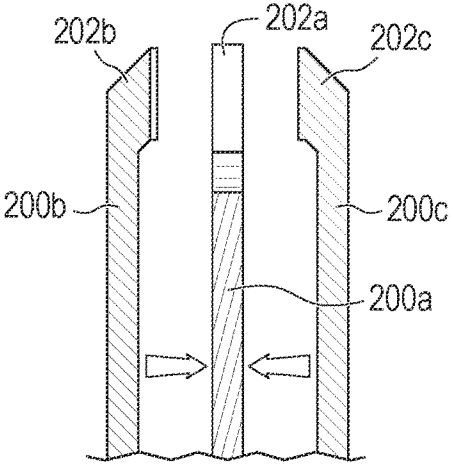
FIGS. 5*a*-5*e* illustrate saw blades used to cut grooves into the luxury vinyl plank for folding.
Figure 5C:
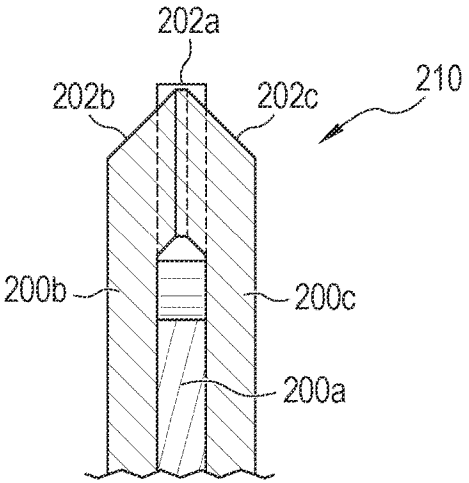
Figure 5A:
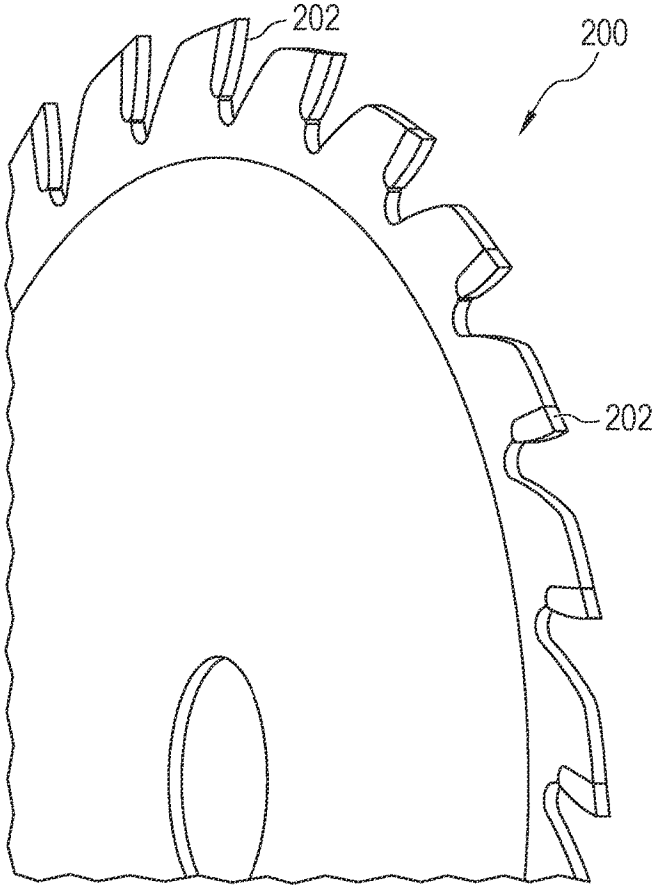

FIGS. 5*a*-5*e* illustrate saw blades usable to cut grooves 110. One way to cut groove 110 is to take three normal table saws and shape their teeth to form the three different groove regions, i.e., horizontal surface 112 and the two diagonal surfaces 116. FIG. 5*a* shows a normal circular saw blade 200 that can be used. Teeth 202 on blade 200 can be shaped as necessary. Buying a blade 200 with as large of teeth 202 as possible will provide the greatest flexibility in shaping the teeth to the desired profile.

FIG. 5*b* shows three saw blades with their teeth cut to make the profile of groove 110. Middle blade 200*a* has rectangular teeth 202*a*, shaped to the desired width of horizontal surface 112, e.g., 3.2 mm. Outer blades 200*b* and 200*c* are shaped to have teeth 202*b* and 202*c* with 45-degree outer surfaces to correspond to the desired cuts for diagonal surfaces 116. Outer blades 200*b* and 200*c* may be made from the exact same circular saw blades as middle blade 200*a*, or a lower diameter blade may be used. Teeth 202 can be shaped using sanding, grinding, or another suitable process.

With blades 200*a*-200*c* ground down to the desired shapes, the three blades are combined to operate as a single blade on a table saw. FIG. 5*c* illustrates the combined blade 210. Outer blades 200*b* and 200*c* are rotated slightly toward or away from the viewer so that teeth 202 of the outer blades are interleaved between the teeth of middle blade 200*a*. That rotation allows teeth 202*b* and 202*c* of outer blades 200*b* and 200*c* to extend toward each other into the cut profile of middle blade 200*a* between teeth 202*a*. The angled edges of teeth 202*b* and 202*c* are usually longer than angled surfaces 116 of the resultant grooves 110.

Combined blade 210 has the appropriate profile to cut groove 110 due to being cut to the proper dimensions. However, the individual blades 200 will eventually need to be sharpened. Keeping the proper saw blade profile after sharpening can be a challenge. The profile of combined blade 210 can be adjusted by adding shims or washers 212 between the individual blades 200*a*-200*c* as shown in FIG. 5*d*. Moving outer blades 200*b* and 200*c* in the X direction on the illustrated axis adjusts the height in the Y direction where the tops of the outer blades meet middle blade 200*a*. Because the cut angle is 45 degrees, the distance of movement in the X direction will result in an equal distance being added to or removed from vertical surfaces 114 in grooves 110. Shims 212 allow adjustment of the profile of combined blade 210 to make sure that groove 110 is properly dimensioned.

Figure 5E:
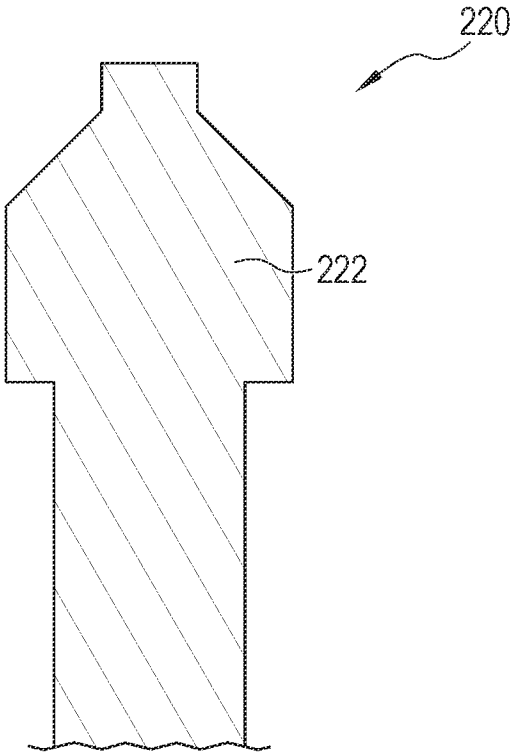
Figure 5D:
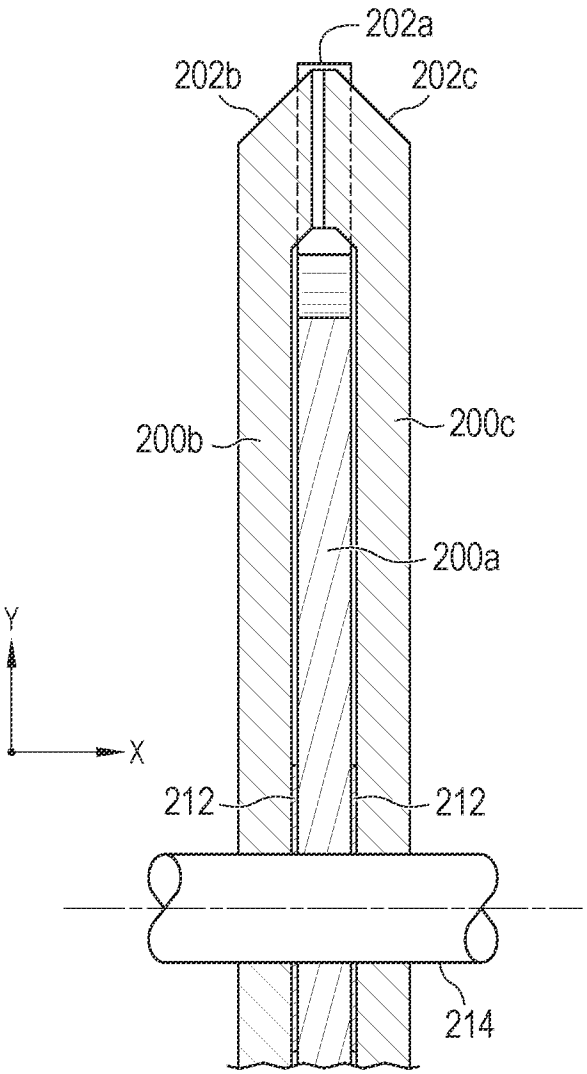

As an alternative, FIG. 5*e* shows a blade 220 that is a single blade with each individual tooth 222 manufactured in the profile for grooves 110. Having a single blade 220 means that the profile can no longer be adjusted using shims 212, but also means that sharpening teeth 222 into the profile of groove 110 is easier. Grooves 110 can also be cut using a router bit with the appropriate profile for cutting grooves 110. However, using a router bit has the downside of being difficult to sharpen without permanently changing the profile shape.

Figure 6B:
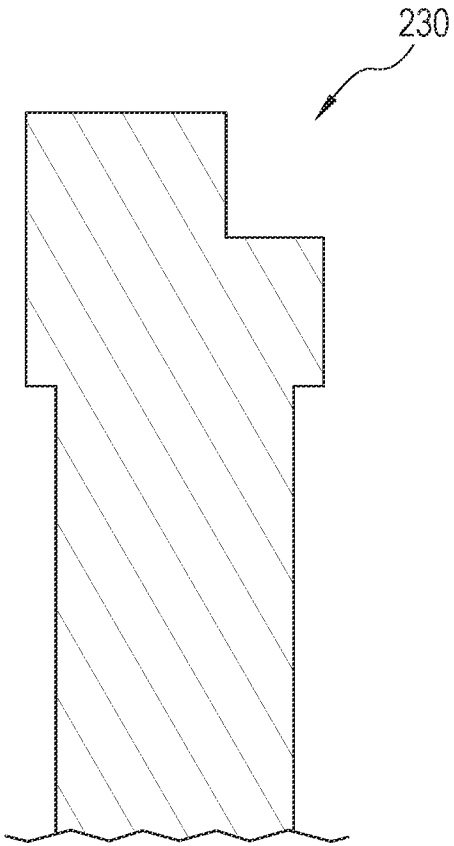
FIGS. 6*a* and 6*b* illustrate saw blades used to cut the alternative groove profile.
Figure 6A:
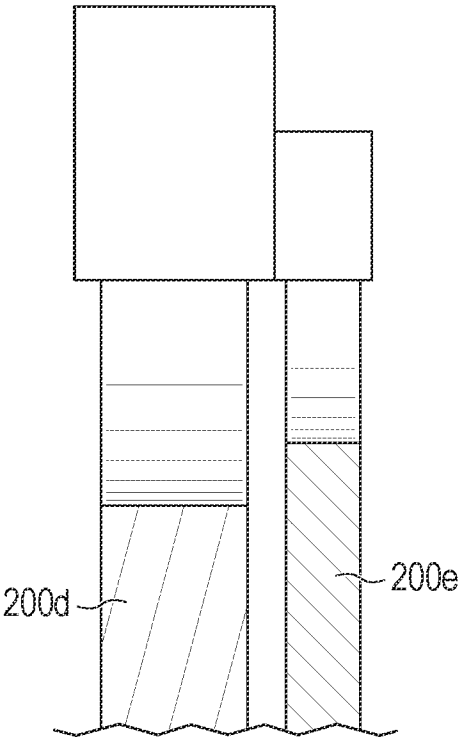

FIGS. 6*a* and 6*b* illustrate a similar concept for saw blades used to form grooves 180. Two rectangular blades 200*d* and 200*e* can be combined as shown in FIG. 6*a*. Blade 200*d* has a larger diameter for deep cut 182 and blade 200*e* has a smaller diameter for shallow cut 186. Again, blades 200*d* and 200*e* can be made from the same input blades, with blade 200*e* simply having more of each tooth removed to reduce the overall diameter and width. Depending on the width of deep cut 182, two or more saw blades may be combined to form the deep cut while a third makes shallow cut 186. FIG. 6*b* shows a single blade 230 with each tooth having the profile of groove 180.

To create grooves using the above blades, the blades are installed into a table saw and planks 100 are run across the table saw. The cutting process begins by optionally heating up planks 100. A stack or pallet of planks can be placed in a heated area or container prior to having grooves cut. A bread proofing box can be used for instance. Heating planks 100 prior to cutting grooves makes clearcoat layers 58 more flexible, thus helping reduce the likelihood that the clearcoat layers will chip during the sawing process. Planks 100 are heated to 98 degrees Fahrenheit (° F.) in one embodiment.

Figure 7A:
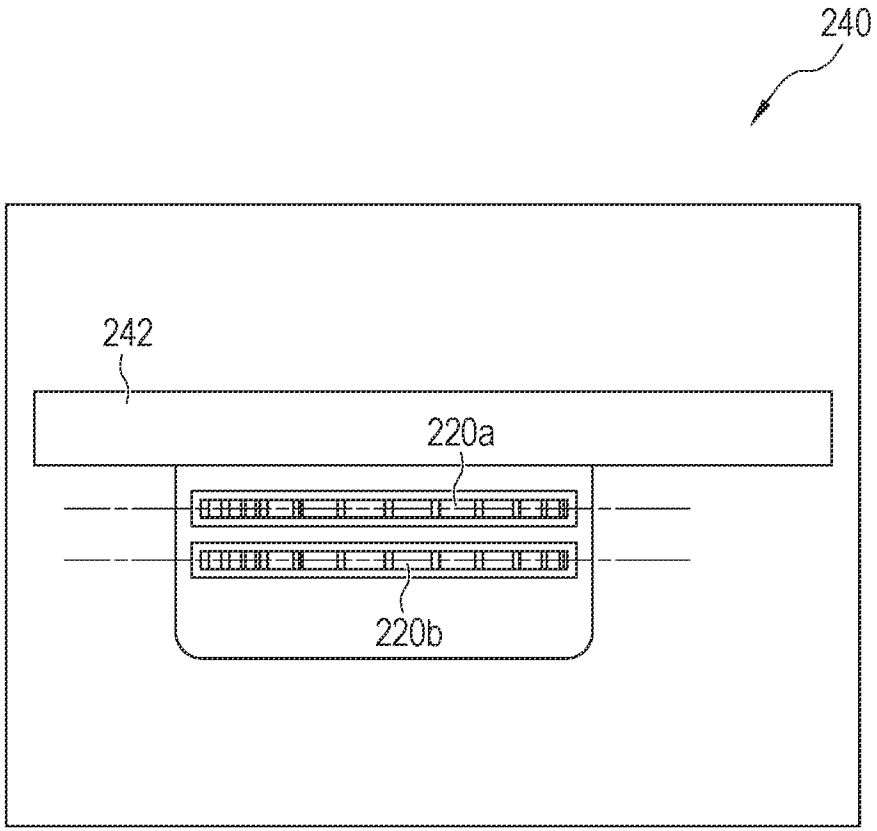
FIGS. 7*a*-7*c* illustrate table saw configurations used to cut grooves into luxury vinyl planks.

FIG. 7*a* shows a table saw 240 with a pair of blades 220*a* and 220*b* disposed on a single axle to cut grooves 110*a* and 110*b*, respectively. Blades 220*a* and 220*b* are set at a level where the blades cut to the desired depth into plank 100, i.e., the peak of the blades is 7 and ⅓ mm over the top surface of table saw 240 to create grooves 110 that leave flexible portion 120 with a thickness of ⅔ of a millimeter for 8 mm thick planks. A plank 100 is run across blades 220 using guide 242 to ensure that grooves 110 are positioned properly.

Figure 7B:
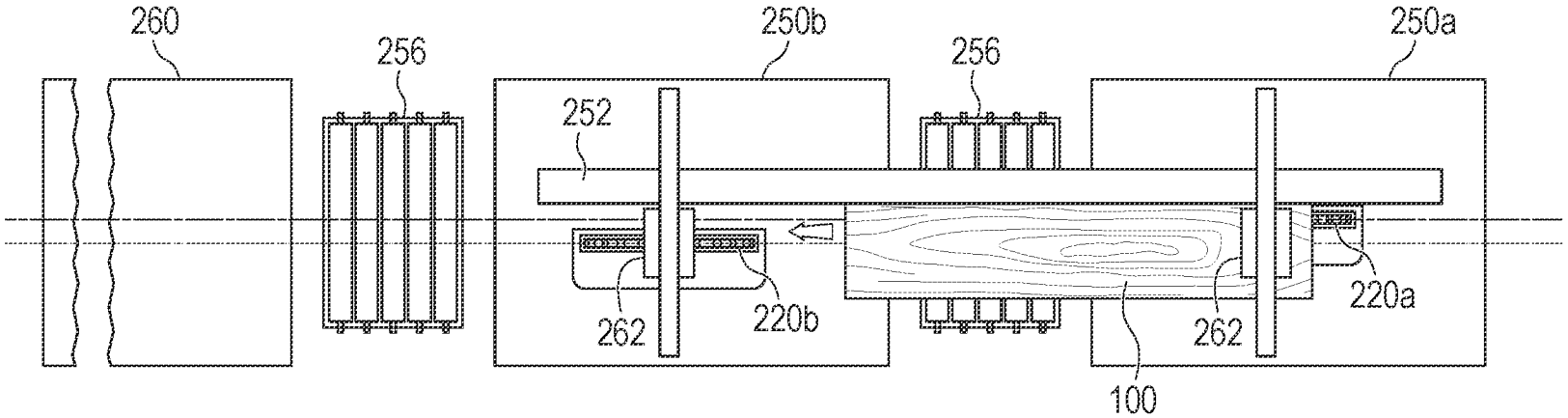
Figure 7C:
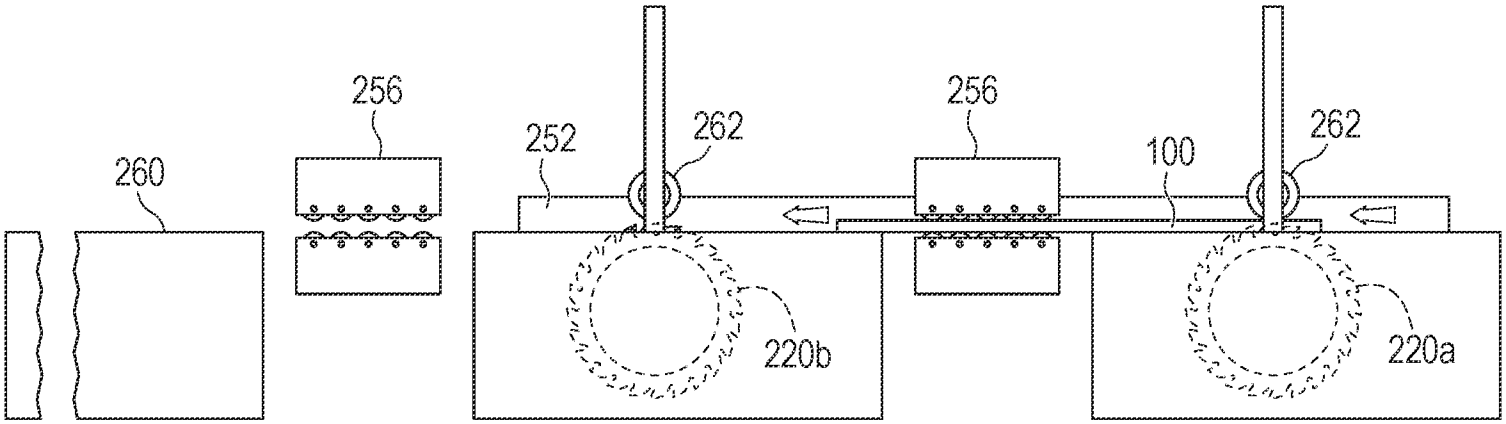

FIGS. 7*b* and 7*c* show another embodiment where two separate table saws 250*a* and 250*b* are used to cut grooves 110 one at a time. Cutting one groove at a time with two table saws 250 is a smoother and less error-prone process than doing both grooves at once. Guide 252 keeps planks 100 aligned properly relative to blades 220. The process of doing two cuts serially can be automated by using motorized rollers 256 to feed a plank 100 into the table saw setup, move the planks from table saw 250*a* to table saw 250*b*, and then drop the plank onto table 260 to await further processing. A second guide 252 can be used on the other side of planks 100 to keep the planks aligned throughout the automated process. Wheels 262 are disposed over blades 220 to keep planks 100 down on the table surface while being cut. Any type of power feeder could be used to move a plank 100 through one or two table saws. A special machine could be made to automatically cut two grooves into plank 100 instead of using two off the shelf table saws.

Figure 8A:
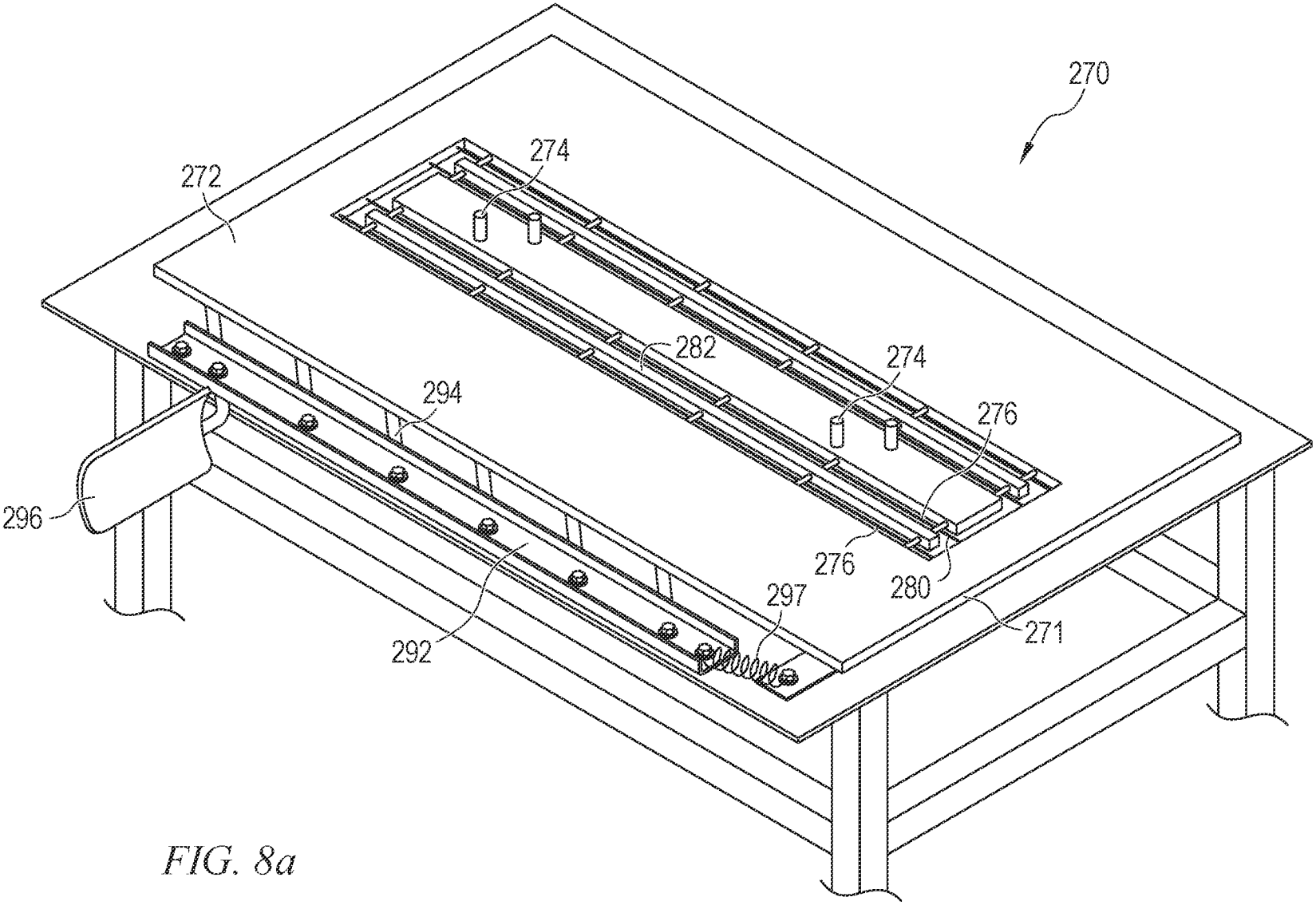
FIGS. 8*a*-8*c* illustrate a table setup to fold and glue the luxury vinyl planks.
Figure 8B:
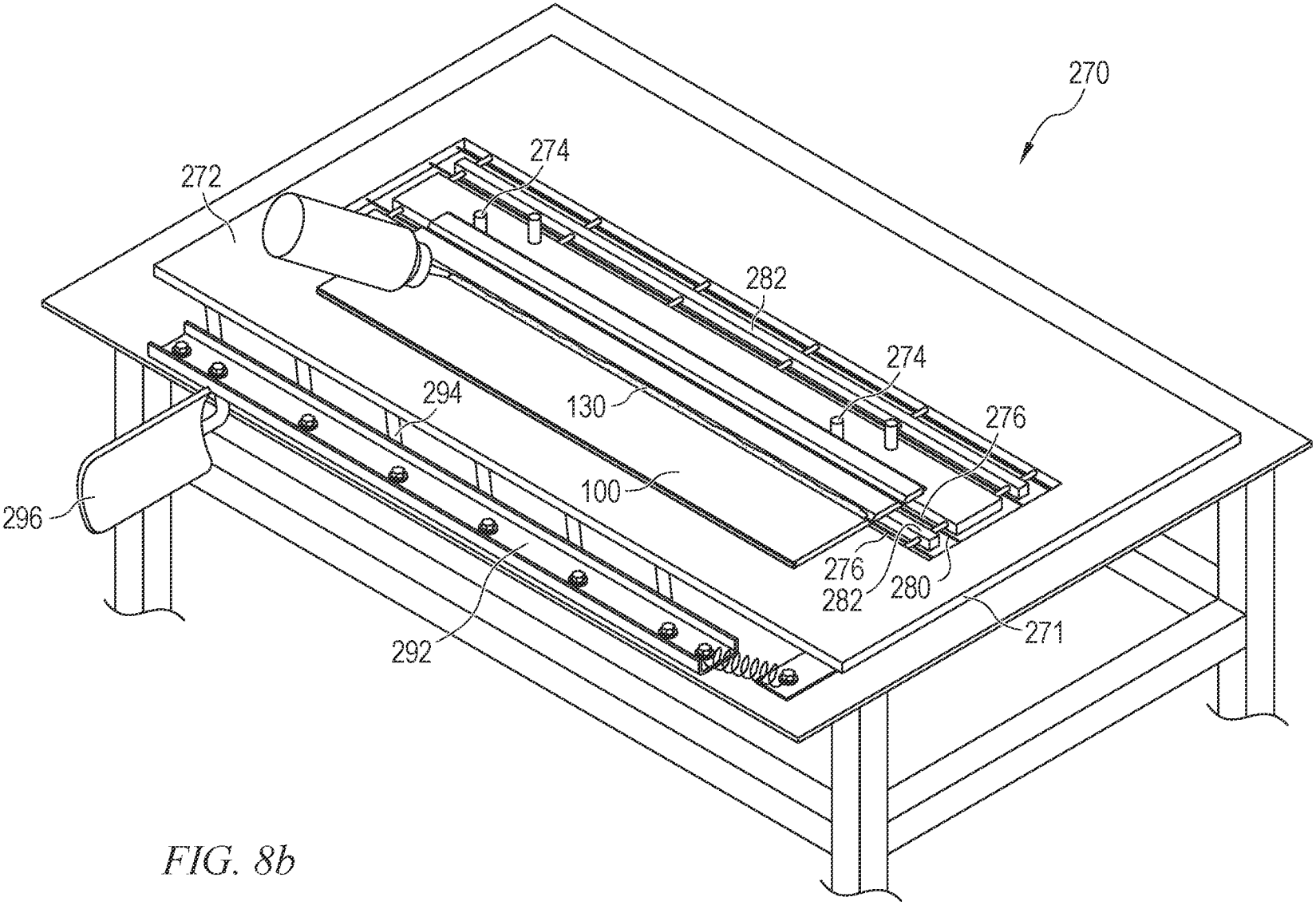
Figure 8C:
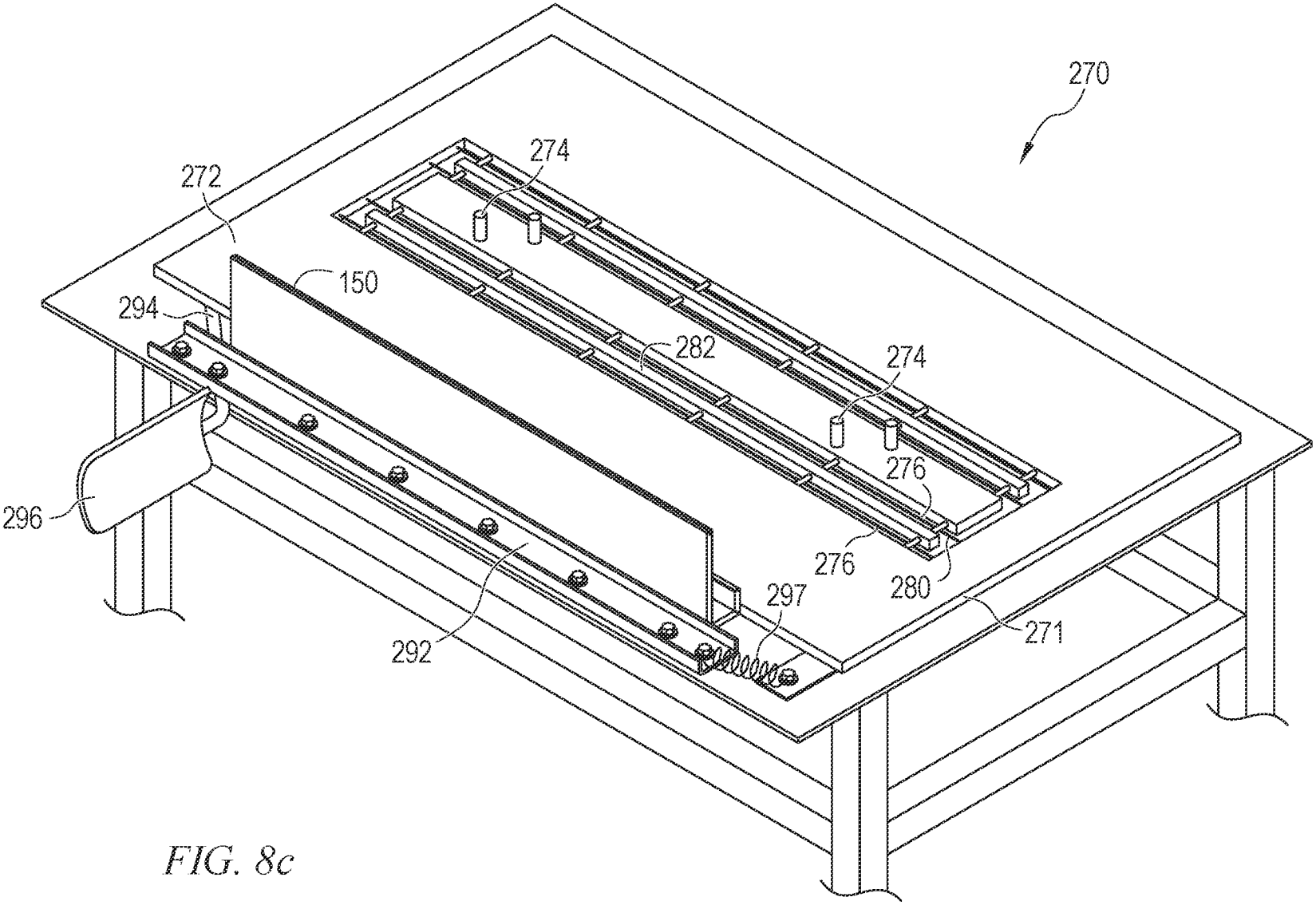

FIGS. 8*a*-8*c* illustrates a station 270 used to glue and fold planks 100 after grooves 110 are formed. Station 270 is double-sided so that two planks can be folded and glued at the same time by two different workers standing on opposite sides of the table. Station 270 includes a table 271 with a large flat working surface 272 to support a plank 100. Alignment pegs 274 are used to align plank 100 parallel to heating slots 276 with the grooves directly over the slots. Plank 100 is set on surface 272 with grooves 110 oriented upward as shown in FIG. 8*b*, and then slid back against pegs 274. Two pegs 274 are used to keep the plank 100 grooves parallel to and directly over slots 276. In other embodiments, more pegs, a flat guide surface, or any other suitable mechanism could be used to keep planks 100 positioned properly on surface 272. A worker could also just align grooves 110 over slots 276 by sight without an alignment mechanism.

A heating element 280 is disposed under slots 276. Any type of heating element is usable, e.g., a gas burner or a resistive electric heater. The heating element can be as simple as a food warmer lamp. Slots 276 are positioned directly under grooves 110 with a portion 282 of table 271 limits heat being directly applied to the portion of plank 100 between the grooves. Applying heat specifically to grooves 110 and limiting the application of heat to other areas of planks 100 helps the planks fold at the grooves without bending or being misshapen in other areas. The thinner areas of plank 100 at grooves 110 heat up more quickly than the areas remaining at full thickness, so heating just the grooves is relatively easy. A target temperature of 125° F. is sufficient for folding planks 100 and will keep the planks under most manufacturers' recommended maximum temperature.

Next, adhesive 130 is disposed into grooves 110. Adhesive 130 is a two-part adhesive in one embodiment. The two-part adhesive involves first spraying an activator into grooves 110 and then dispensing in a bead of glue. Cyanoacrylate (CA) glue is one suitable adhesive. Once the CA glue is applied onto the activator in grooves 110, the worker has about 10 seconds to fold plank 100 into the desired shape for stair nose 150 before the glue becomes too hard to work.

Another embodiment uses a single-stage hot urethane or polyurethane (PUR) adhesive. The PUR adhesive is dispensed into grooves 110 at a high enough temperature, typically 230° F., that a separate heating element 280 is not required. Using a PUR adhesive to heat the area around grooves 110 provides sufficient heat without needing heating elements 280 and keeps heat localized to the grooves without requiring slots 276. Adhesive 130 can be dispensed from a bottle, fed in from a large tank using a hose and nozzle, or applied using any other suitable mechanism.

Once adhesive 130 is disposed in grooves 110, plank 100 is folded up into two 90-degree angles and placed between table 271 and clamp bar 292 as shown in FIG. 8*c*. Clamp bar 292 runs parallel to the edge of table 271 and is attached to the table by a plurality of flat swing arms 294 that form parallelograms. The top surfaces of swing arms 294 are perpendicular to the inner surfaces of clamp bar 292 and table 271 so that together the three surfaces hold plank 100 folded into two 90-degree angles.

One of the swing arms 294 has a switch 296 extending out past clamp bar 292 that a worker can press with his or her hip to move the clamp bar away from table 271 and allow insertion of a folded-up plank 100. Clamp bar 292 is spring loaded with spring 297 so that when the worker stops pressing on switch 296 the clamp bar compresses plank 100 between the clamp bar and table 271 to hold the 90-degree folds without additional input from the worker. In other embodiments, springs 297 are used at both ends of clamp bar 292. FIG. 8*c* shows the spring compression of clamp bar 292 holding the 90-degree angles while the glue dries so that the worker can grab another plank 100 and get heat and glue applied while the first plank's adhesive dries.

The folding of plank 100 will squeeze some adhesive 130 out to form a visible bead inside stair nose 150. For two-part adhesives, an addition spray of activator can be applied after folding to ensure that the bead hardens. The activator helps adhesive 130 get a better grip on the inside of the folds and reduces the amount that the wet adhesive runs on the inner surfaces of stair nose 150. 20-30 seconds of drying is typically sufficient for adhesive 130, and then the completed stair nose 150 can be stacked for packaging and shipment to the customer.

In some embodiments, heating, applying adhesive, folding, and holding while the adhesive dries can all be automated. A robot can apply adhesive before running a plank 100 through a folding machine, such as one that might be used for roll forming sheet metal into channel beams. The entire process from loading a plank 100, cutting grooves 110 or 180, to gluing the folds in place can be automated by connecting robots in an assembly line. Robots can be configured to take a pile of new planks 100 and convert the planks into a stack of stair nosings 150 without human intervention.

In addition to stair nosing, other types of molding can be formed by cutting and folding luxury vinyl plank flooring. Any type of molding can be formed, and each has the advantage of matching the surrounding flooring due to being formed from one of the same planks that was used for the flooring.

Figure 9A:
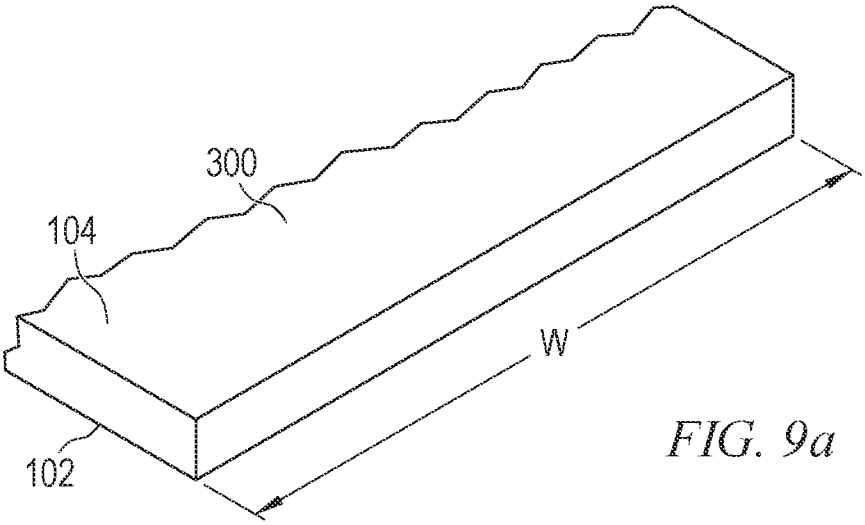
FIGS. 9*a*-9*d* illustrate forming T molding out of a luxury vinyl plank.

FIGS. 9*a*-9*d* show one example where a T molding is made from an LVP flooring plank. FIG. 9*a* shows an LVP strip 300. LVP strip 300 is formed by cutting plank 100 into strips with the desired length and width for forming a molding. The width W in FIG. 9*a* should be selected greater than the final desired width of the molding in order to accommodate the manufacturing process. In one embodiment, the additional width of strip 300 is between ½ inch and 1 inch.

Figure 9B:
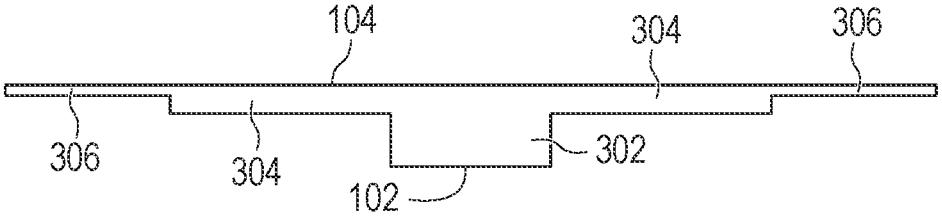

To form strip 300 into a T molding, the strip is cut or shaved down to the profile shown in FIG. 9*b*. Middle portion 302 stays at the full thickness of plank 100 and operates as the vertical portion of the T molding. Middle portion 302 can be sized as desired for the particular T molding being manufactured. In one embodiment, middle portion 302 has a width suitable for insertion into a metal track that holds the T molding in place. Middle portion 302 can be given sloped side surfaces to apply pressure against track walls as the T molding is inserted.

Platforms 304 surround middle portion 302 on both sides and have bottom surface 102 shaved down to about 20-25% of the total plank 100 thickness, i.e., about 75-80% of the plank material is removed within the footprints of platforms 304. In one embodiment, a thickness of platforms 304 is about 1 mm and a width of each platform 304 is between ¼ and ½ inch. Platforms 304 will be the portion of the T molding that sits on the surrounding flooring, while middle 302 will be the portion of the T molding that sits between the surrounding flooring.

Figure 9C:
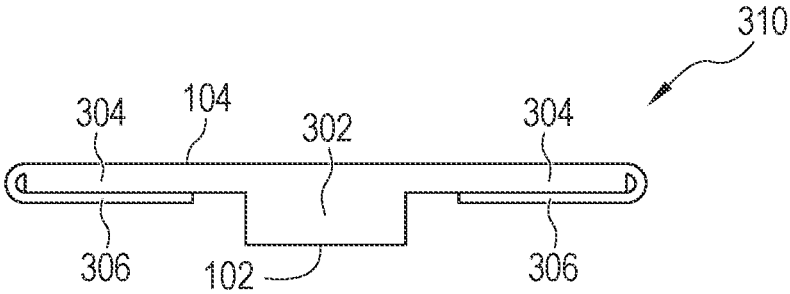

Flaps 306 have bottom surface 102 of strip 300 shaved down to between ½ mm and ⅔ mm thickness. The exact thicknesses of flaps 306 and platforms 304 are not critical, but the flaps should be thin enough to be folded under the platforms as shown in FIG. 9*c*. Platforms 304 should be thick enough to allow flaps 306 to be folded under without the platforms being bent.

Platforms 304 and flaps 306 can be cut or shaved down using a single saw with a profile matching the desired shape, as done above for grooves 110 and 180. One platform 304 and flap 306 could be cut followed by the platform and flap on the other side of middle 302. Heat can be applied as with grooves 110 and 180 to reduce the likelihood of damaging the clearcoat layers. In another embodiment, a custom planer blade is designed to cut platforms 304 and flaps 306. Any suitable tool or machine can be used to cut a plank 100 into the shape of FIG. 9*b*. A plank 100 can be cut into a plurality of T-shapes shown in FIG. 9*b* in a single step rather than first cutting down to strips 300.

Once plank 100 is cut into the shape shown in FIG. 9*b*, flaps 306 are folded under platforms 304 as shown in FIG. 9*c* and glued. Heat can be applied prior to or during folding flaps 306 to reduce the likelihood of image layer 56 and clearcoat layers 58 cracking. A CA, PUR, or other adhesive is used to fix flaps 306 to the undersides of platforms 304. The width of flaps 306 should be long enough to allow adhesive to sufficiently adhere the flaps to platforms 304 but short enough so that the flaps do not overlap middle 302 when folded under.

Figure 9D:
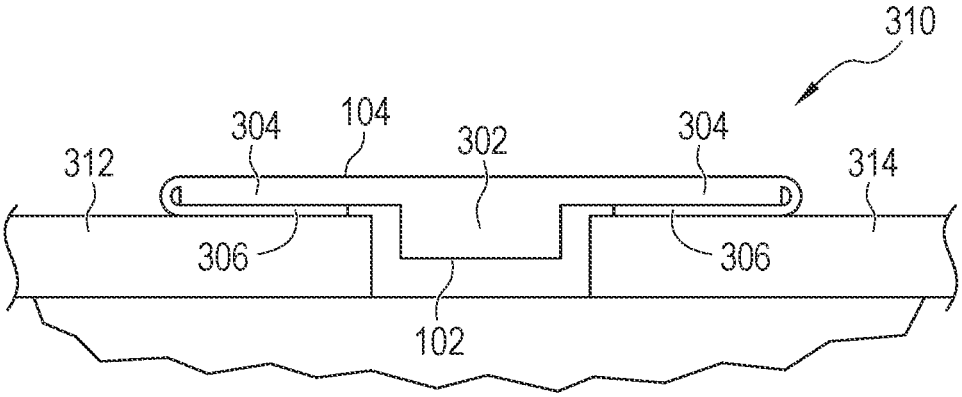

Strip 300 with flaps 306 folded under as shown in FIG. 9*c* is usable as a T molding 310. FIG. 9*d* shows T molding 310 in use. Platform 304 and flap 306 on one side of middle 302 sit on flooring 312 and the other platform and flap sit on flooring 314. Middle portion 302 extends down between flooring 312 and flooring 314. T molding 310 can be used anywhere two floorings meet. Flooring 312 might be made of planks 100 while flooring 314 is a tile floor, or the floorings could be two different patterns of LVP planks. T molding 310 can also be used where different areas of the same LVP pattern meet, e.g., if two adjacent rooms were independently covered in the same style of LVP and a molding is needed to cover up a seam between the two.

Whatever the case, T molding 310 covers up the seam where flooring 312 meets flooring 314. A seamless look by snapping connectors 60 together is difficult to get since the two flooring sides are laid independently. Flooring 312 and 314 are laid with about an inch of space between them, then the gap is covered with T molding 310. T molding 310 can optionally be glued down or snapped into a track in the gap between floorings 312 and 314. Because T molding 310 is formed from one of the same planks that are used to make one or both of floorings 312 and 314, the T molding matches the flooring almost perfectly.

FIGS. 10*a*-10*e* illustrate forming an end molding from plank 100. A strip 300 is again cut from plank 100, and then cut into the profile shown in FIG. 10*a*. Middle portion 302 again remains at the full thickness of planks 100. One side of middle portion 302 has a platform 304 and a flap 306 as with T molding 310.

Figure 10A:
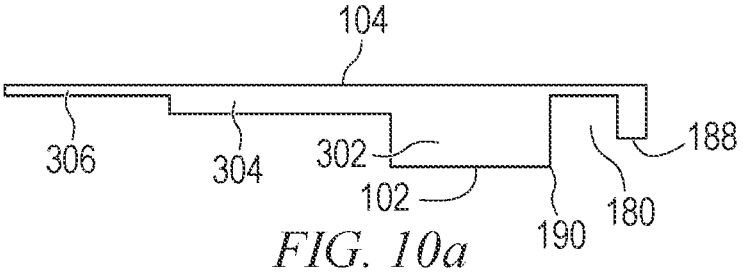
FIGS. 10*a*-10*e* illustrate forming end molding out of a luxury vinyl plank.
Figure 10B:
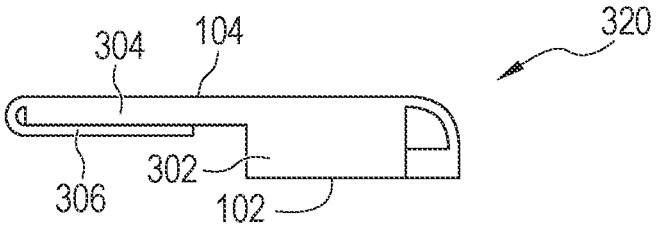

The opposite side of middle 302 has a groove 180 formed to allow that side to fold down at 90 degrees, like the folds done with stair nosing 150. FIG. 10*b* shows flap 306 folded under platform 304 and glued. Groove 180 is also folded down 90 degrees and glued as when forming stair nosing to complete an end molding 320. To use end molding 320, platform 304 and flap 306 are set on flooring as with T molding 310, and the 90-degree angle on the opposite side extends downward to the underlying floor.

Figure 10C:
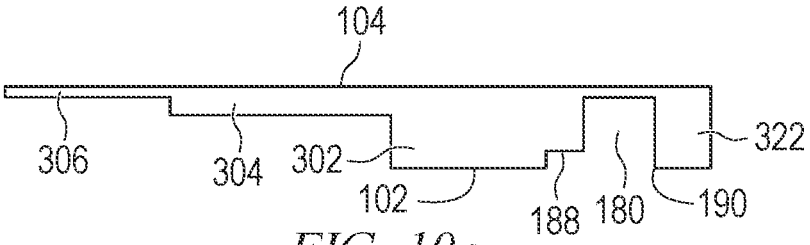
Figure 10D:
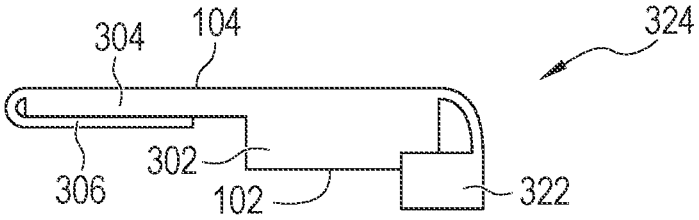
Figure 10E:
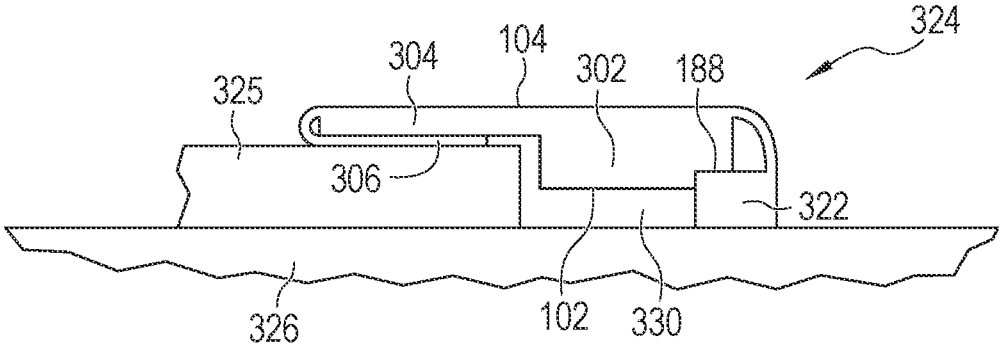

Groove 110 can be used as well as groove 180. Groove 180 is non-symmetrical and can have shelf 188 disposed toward or away from middle 302. FIGS. 10*a*-10*b* form end molding 324 with shelf 188 oriented away from middle 302, while FIG. 10*c* shows groove 180 cut into strip 300 with shelf 188 oriented toward the middle. FIG. 10*c* also shows an optional extension 322 on the opposite side of groove 180 from middle 302. Extension 322 creates vertical lift when folded down as shown with end molding 324 in FIG. 10*d*.

The vertical lift of extension 322 allows top surface 104 to stay horizontal when flooring 325 is made from the same thickness of planks 100 as end molding 324. Extension 322 sits between two parallel surfaces, i.e., floor 326 and shelf 188, which helps strengthen end molding 324 from gap 330 being crushed by a person stepping on the end molding. Gap 330 can also be filled with an adhesive or something solid like a strip of plastic, wood, or metal to further strengthen end molding 324. An additional cut could be made into middle 302 to create a structure sized to be used with a metal track nailed down to the floor.

End molding 320, with shelf 188 oriented away from middle 302, could also be made with an extension 322 to lift the grooved side of the end molding. End moldings 320 and 324 are commonly used where LVP flooring ends and a totally different type of flooring is used, e.g., carpet. End moldings 320 and 324 match flooring 325 due to being made from the same planks 100 that the flooring is made from.

The above disclosed methods and devices are described with reference to luxury vinyl plank flooring but apply equally to other types of plank flooring that are sufficiently flexible. For instance, while the illustrated embodiment is made from a luxury vinyl plank (LVP), other type of flooring planks are used in other embodiments. Stone plastic composite (SPC), wood plastic composite (WPC), and engineered vinyl plank (EVP) flooring is a non-exhaustive list of other similar types of flooring that can be used in the above-described method to form molding out of flooring planks.

While two specific groove designs are disclosed, i.e., groove 110 and groove 180, other groove profiles can be used to allow a floor plank to be bent and used as a molding. Stair noses can be made using any number and angle of folds, e.g., three 60-degree angles could be used instead of two 90-degree angles to create a pointed nose. The total of all fold angles does not necessarily need to equal 180 degrees.

Figure 11B:
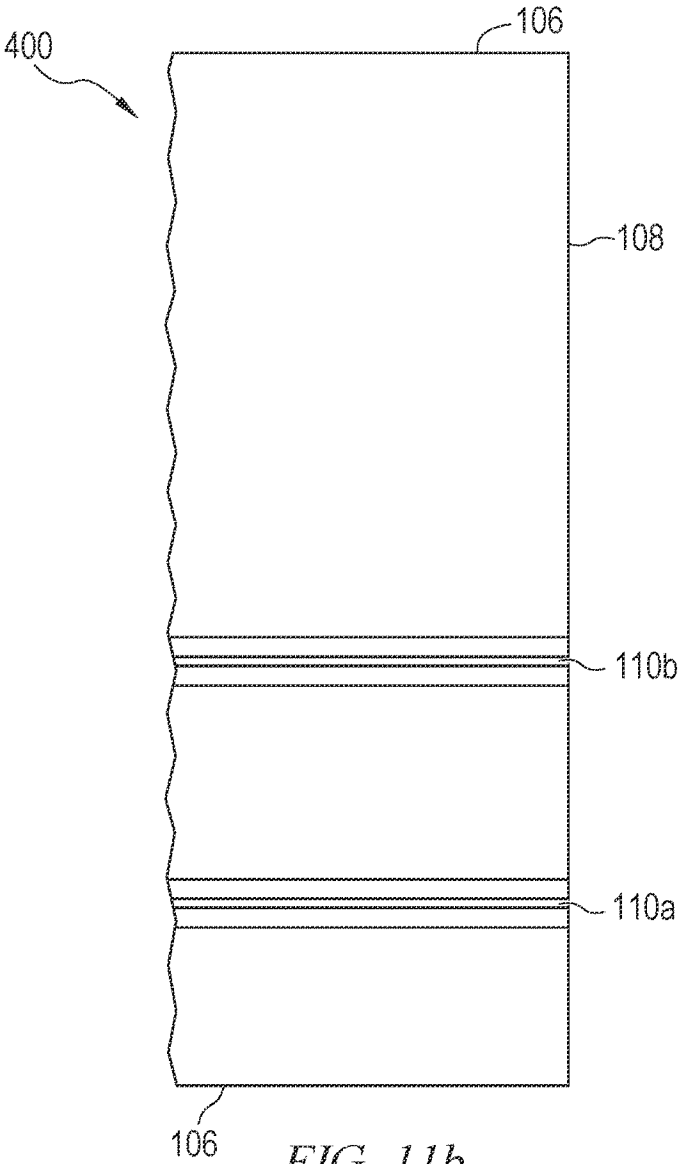
FIGS. 11*a*-11*g* illustrate forming a stair tread from a larger plank.
Figure 11A:
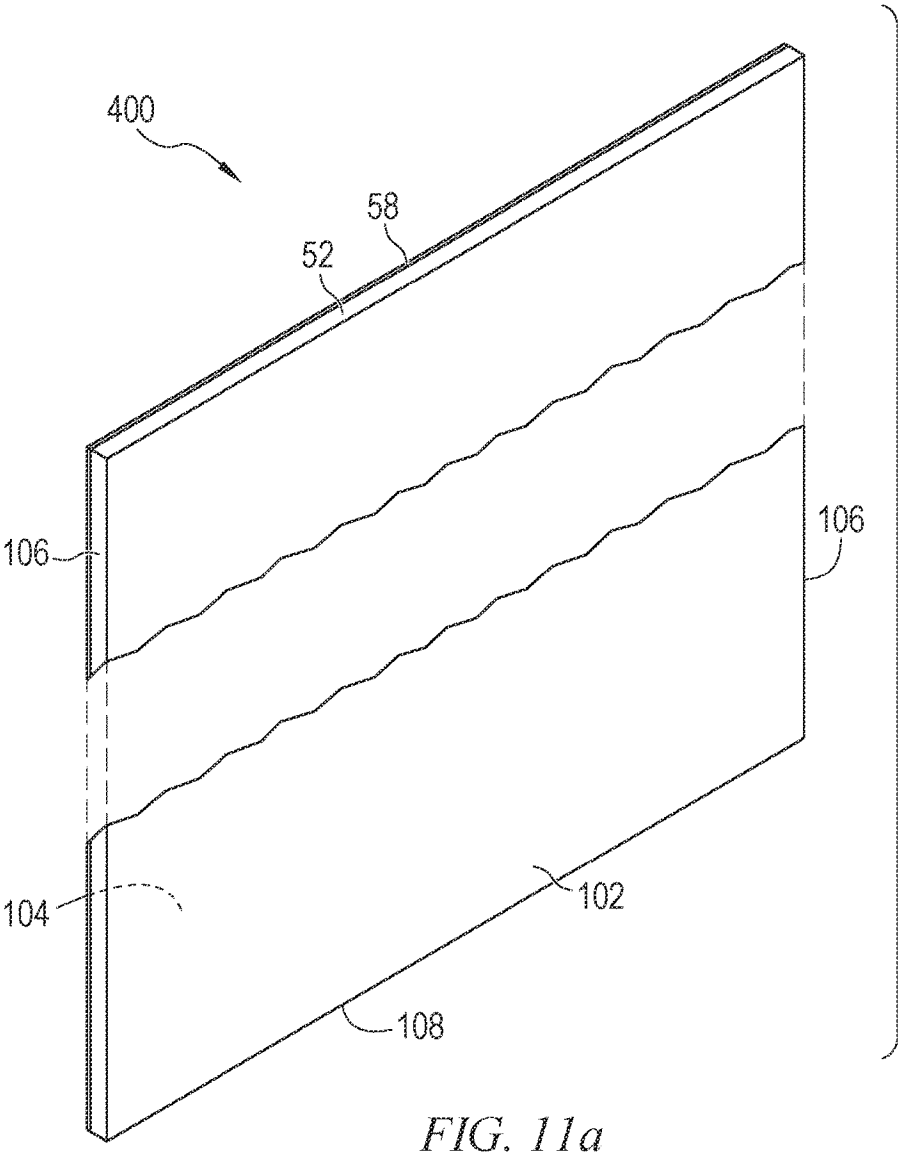

FIGS. 11*a*-11*g* illustrate an embodiment where a stair nose is made from a flooring plank such that the resulting stair nose is larger than the stair tread being covered. The stair nose is cut to the size of the stair tread prior to installation. FIG. 11*a* shows a plank 400. Plank 400 is similar to plank 50 but formed with a larger length and width than a typical luxury vinyl floor plank.

Because the stair tread being formed with plank 400 will be used on a step with another vertical riser at the back of the step, plank 400 will not have another plank connected as shown in FIGS. 3*g* and 3*h* above. Therefore, plank 400 is formed without connectors 60 in most embodiments to save the manufacturing work of forming the connectors. Plank 400 is also formed without padding 54 because the padding is not necessary to match the thickness of an adjacent plank. Adhesive used to stick the plank to a stair tread will provide sufficient padding. Forming plank 400 without padding also strengthens the glued corner joints as described above.

Plank 400 is a plank formed specifically for making a stair nose, with specific characteristics that are adapted to that purpose, i.e., greater size, no padding 54, and no connectors 60. Plank 400 is still formed with the same core 52, image layer 56, and clearcoat 58 as other floor planks 50 which are used on the surrounding floors to ensure that the look and feel of the stair noses matches the floors.

In FIG. 11*b*, grooves 110 are formed along the length of plank 400 as described above. Grooves 110 are formed with a uniform cross-section along the entire length of the plank 400 as described above and are spaced out and positioned similarly. The specific positions of grooves 110 can be adjusted as needed to make a different size stair nose. Square grooves like grooves 180, or any other suitable shape of grooves, are used in other embodiments.

Figure 11C:
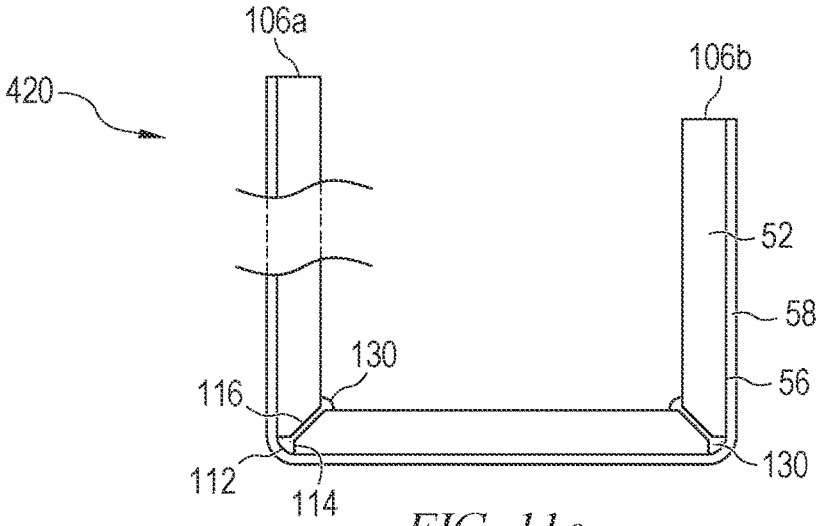
Figure 11D:
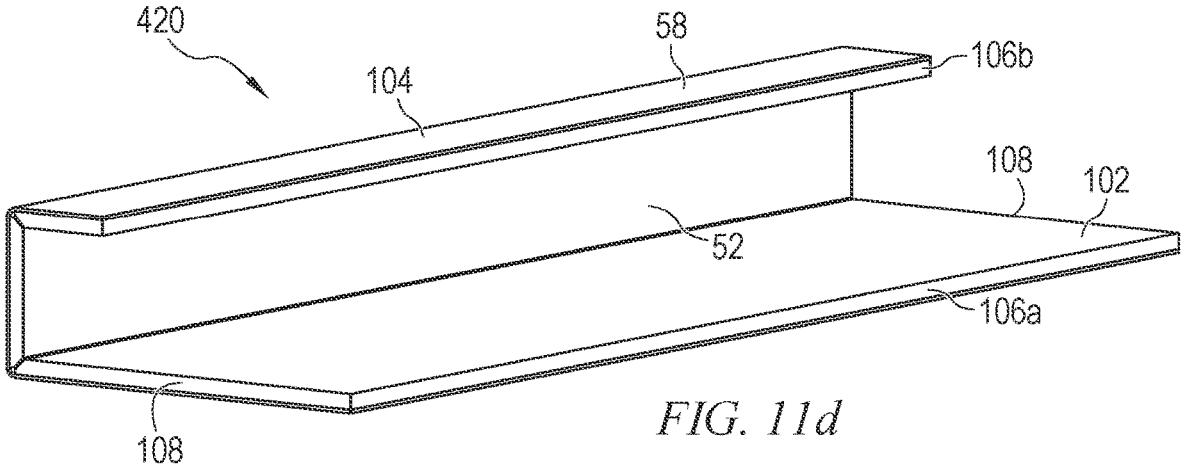

FIGS. 11*c* and 11*d* show plank 400 folded and glued into a stair nose 420. Short edges 108 and long edges 106 are flat rather than having connectors 60. Adhesive 130 is disposed into grooves 110 prior to folding to hold the fold at approximately a 90-degree angle.

Figure 11E:
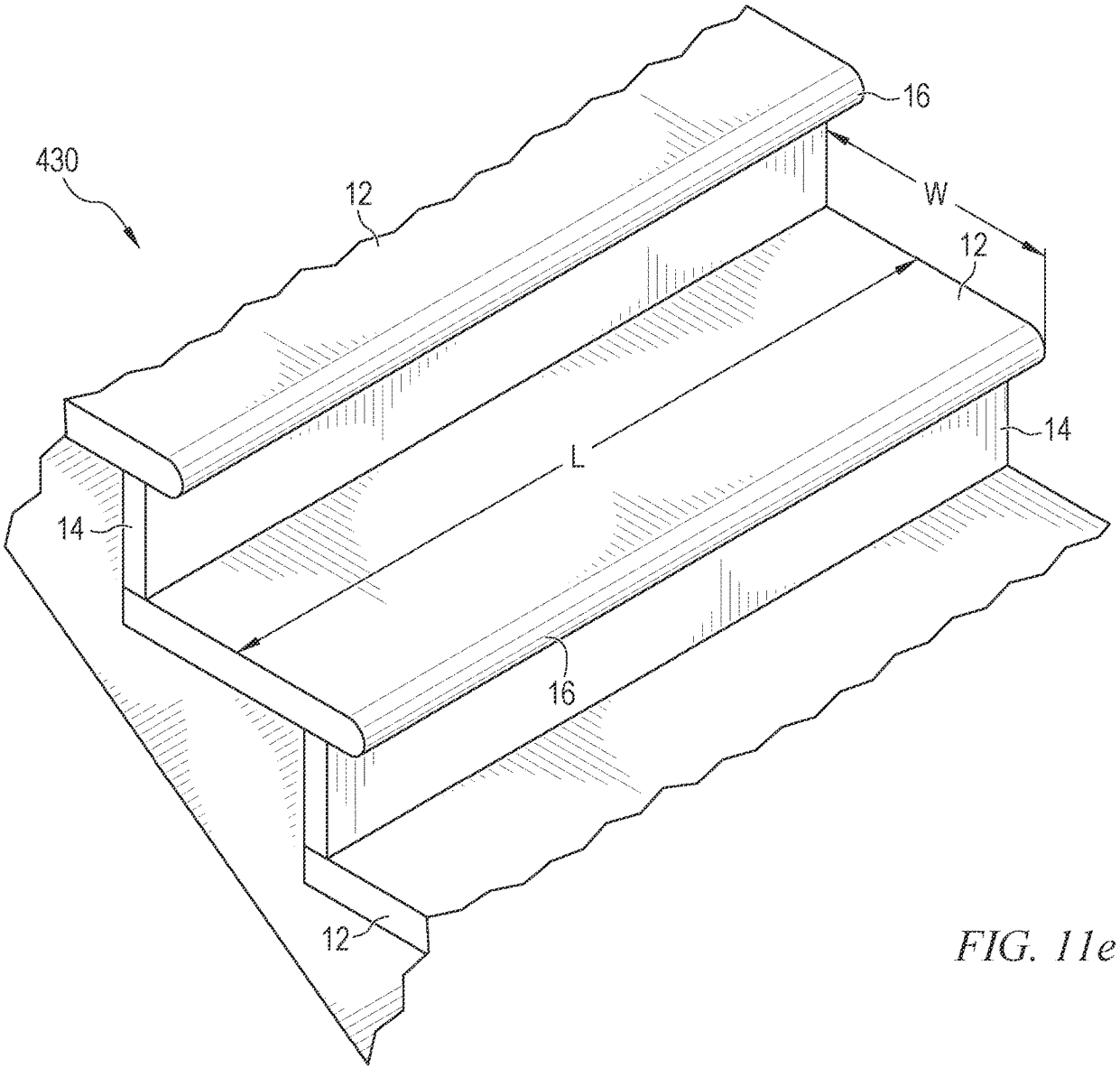

FIG. 11*e* shows a set of stairs 430. Each tread 12 has a length L and a width W that is less than the comparable dimensions of stair nose 420. Therefore, stair nose 420 can be cut down to the length and width of tread 12 and then a single piece of molding can be used to entirely finish each tread. There is no need to connect multiple stair noses together to cover the length of a tread 12 or to connect additional pieces of flooring to fill width of the tread.

Figure 11F:
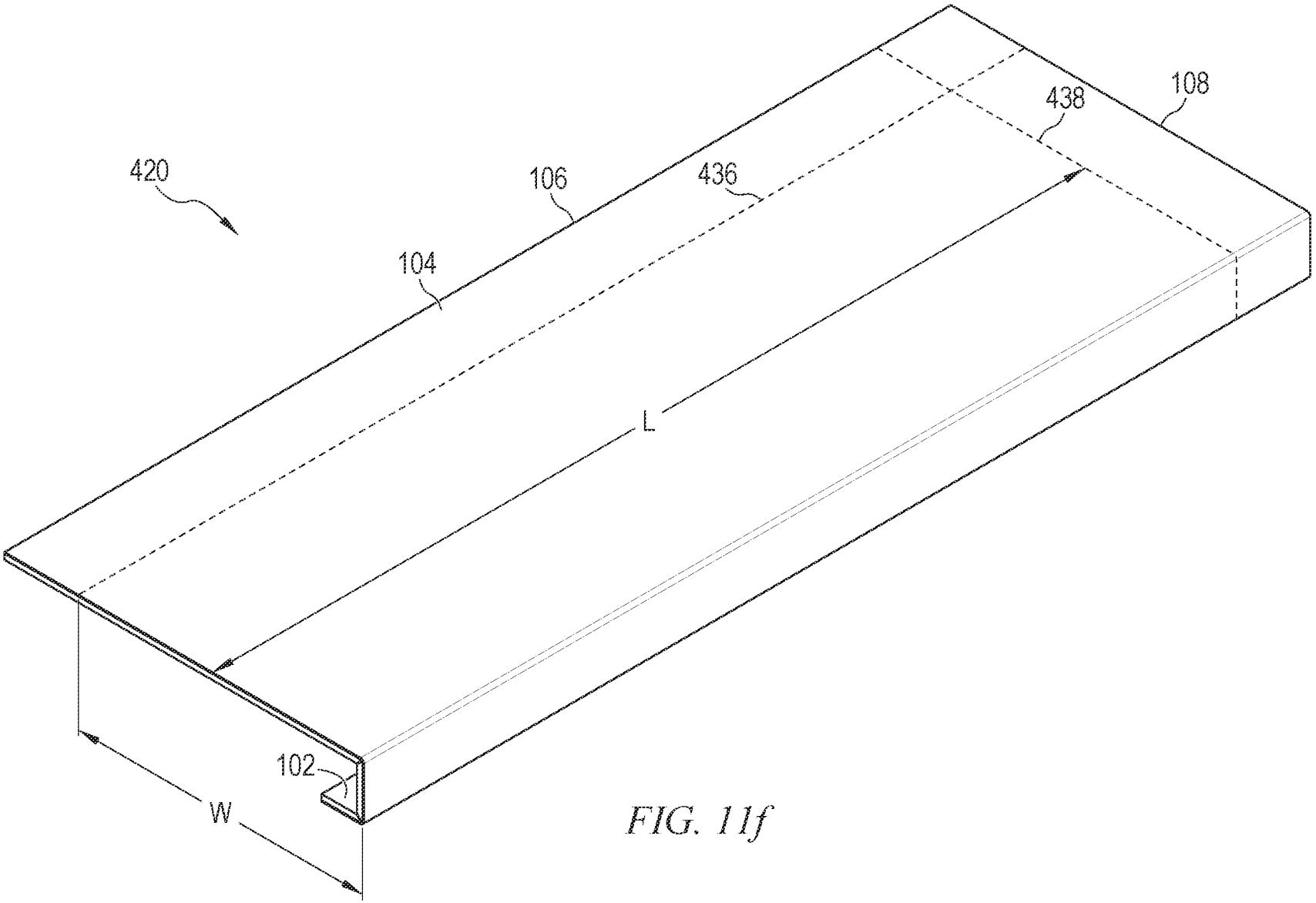

FIG. 11*f* shows two cuts 436 and 438 that can be made to stair nose 420 to give the stair nose the same length L and width W as tread 12. Cut 436 is parallel to long edges 106 to reduce the width of stair nose 420 down to width W of tread 12. Cut 438 is parallel to short edge 108 to reduce the length of stair nose 420 down to length L. Cuts 436 and 438 can be performed using a table saw, circular saw, jig saw, hand saw, laser cutting tool, water jet, or any other suitable cutting mechanism. In other embodiments, stair nose 420 is manufactured to length L and width W, so no cuts are necessary to have a plank the same size as a stair step.

Figure 11G:
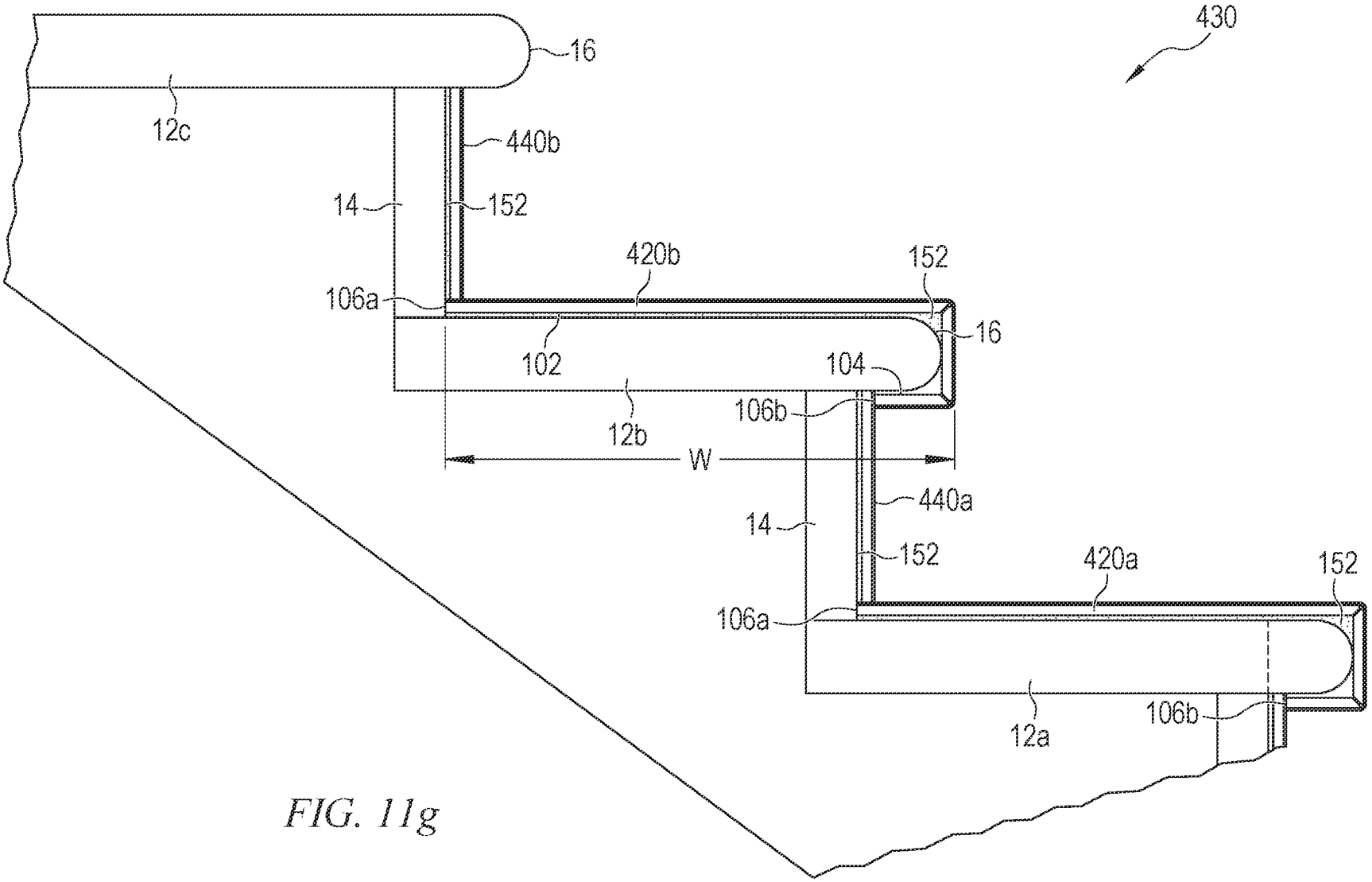

FIG. 11*g* shows stair noses 420 being installed on stairs 430. Installation typically proceeds from bottom of the stairs to the top. Stair nose 420*a* is installed on tread 12*a* using adhesive 152. Back edge 106*a* of nose 420*a* is oriented toward the next higher riser 14.

The length and width of the installed stair nose 420 may intentionally be formed to not exactly match the length and width of a stair nose 12*a* for a variety of reasons. As one example, the width of stair nose 420 may be a millimeter or two short to ensure a proper fit on all steps considering potential variances in the exact width between steps. A small gap will therefore be left between riser 14 and edge 106*a*. A riser cover 440*a* is installed over riser 14 with adhesive 152 and covers up any small gap between nose 420*a* and the riser. Riser cover 440*a* is formed from the same material as stair noses 420 to match the aesthetics of the surrounding floor and stairs. In other embodiments, riser covers 440 that visually contrast with stair noses 420 are used.

Stair nose 420*b* is installed on the next tread 12*b*. Edge 106*b* of stair nose 420*b* can touch riser cover 440*a* or a gap may be left. In other embodiments, riser cover 440*a* is shorter than riser 14, and edge 106*b* may be directly over or behind the riser cover. Edge 106*b* touches riser 14 in some embodiments. Each stair nose 420 fully covers a tread 12 without needing additional floor panels to fill up a gap between the edge 106*a* and riser 14.

For longer steps, two or more stair noses 420 can still be used to fully cover a tread 12, but each nose 420 would typically still be wide enough to reach from nose 16 to the next riser 14. In such cases, connectors 60 can be formed on shorter edges 108. Connectors 60 would be cut off at the ends of each stair tread 12 but would be used internally to connect multiple stair noses 420 to reach the desired length. Connector 60 is cut off or never formed on longer edges 106. Connector 60 can be formed on top edge 106*a* only so that stair noses 420 can be linked up with surrounding flooring at the top of stairs 430.

Using stair noses 420 that are made over-sized for the tread being covered and then cutting the stair noses to size prior to installation simplifies installation and improves aesthetics by reducing the number of seams between panels and the total number of panels that must be placed. Any of the above or below embodiments can be formed from an oversized piece of flooring and then cut to the desired size.

Figure 12B:
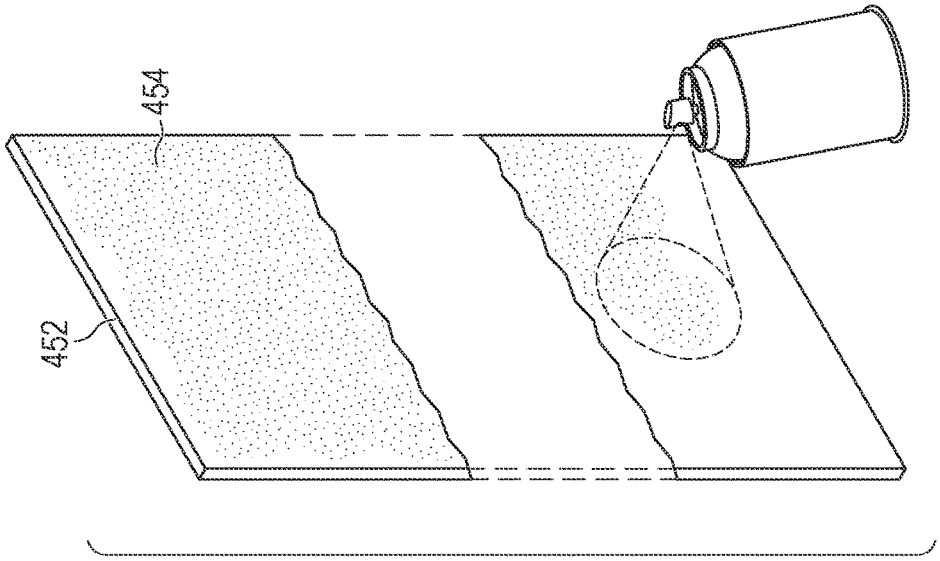
FIGS. 12*a*-12*h* illustrate forming a stair tread from thinner vinyl flooring.
Figure 12A:
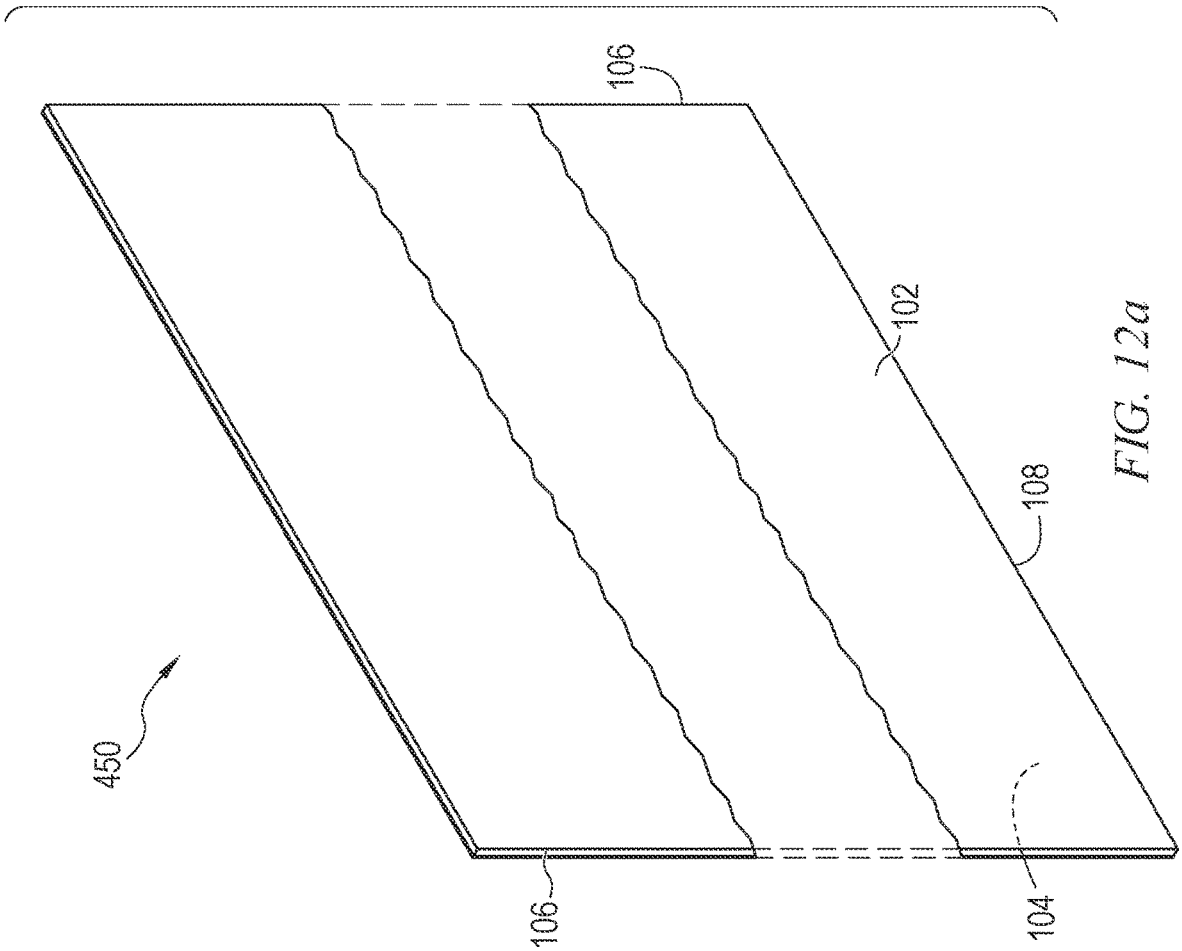

FIGS. 12*a*-12*h* show an embodiment where stair noses are made from thinner and cheaper vinyl flooring. FIG. 12*a* shows a panel of vinyl flooring 450. Vinyl flooring 450 is significantly thinner and more flexible than the luxury plank flooring used above. Vinyl flooring 450 is typically installed by gluing a plurality of pieces of the vinyl flooring onto the floor directly abutting each other. There is no latching system as luxury vinyl planks typically have. The term vinyl may refer to PVC or another vinyl-based or vinyl-like material.

Vinyl flooring 450 is an economical option, but value would still be added by having stair nosing that matched the surrounding flooring. However, due to vinyl flooring 450 being thin and flexible, performing the above-described groove cutting, folding, and gluing will not make a satisfactory stair nose when performed on the vinyl flooring by itself.

FIG. 12*b* shows a backing 452 that can be attached to vinyl flooring 450 to provide enough thickness and strength to form a stair nose. Backing 452 is formed from PVC or vinyl similarly to vinyl flooring 450. Backing 452 is thick enough to allow grooves 110 or 180 to be formed when combined with the thickness of vinyl flooring 450. An adhesive 454 is applied to one surface of backing 452 using a spray can, a spray nozzle as part of an automated system, a brush, or another suitable means.

Figure 12C:
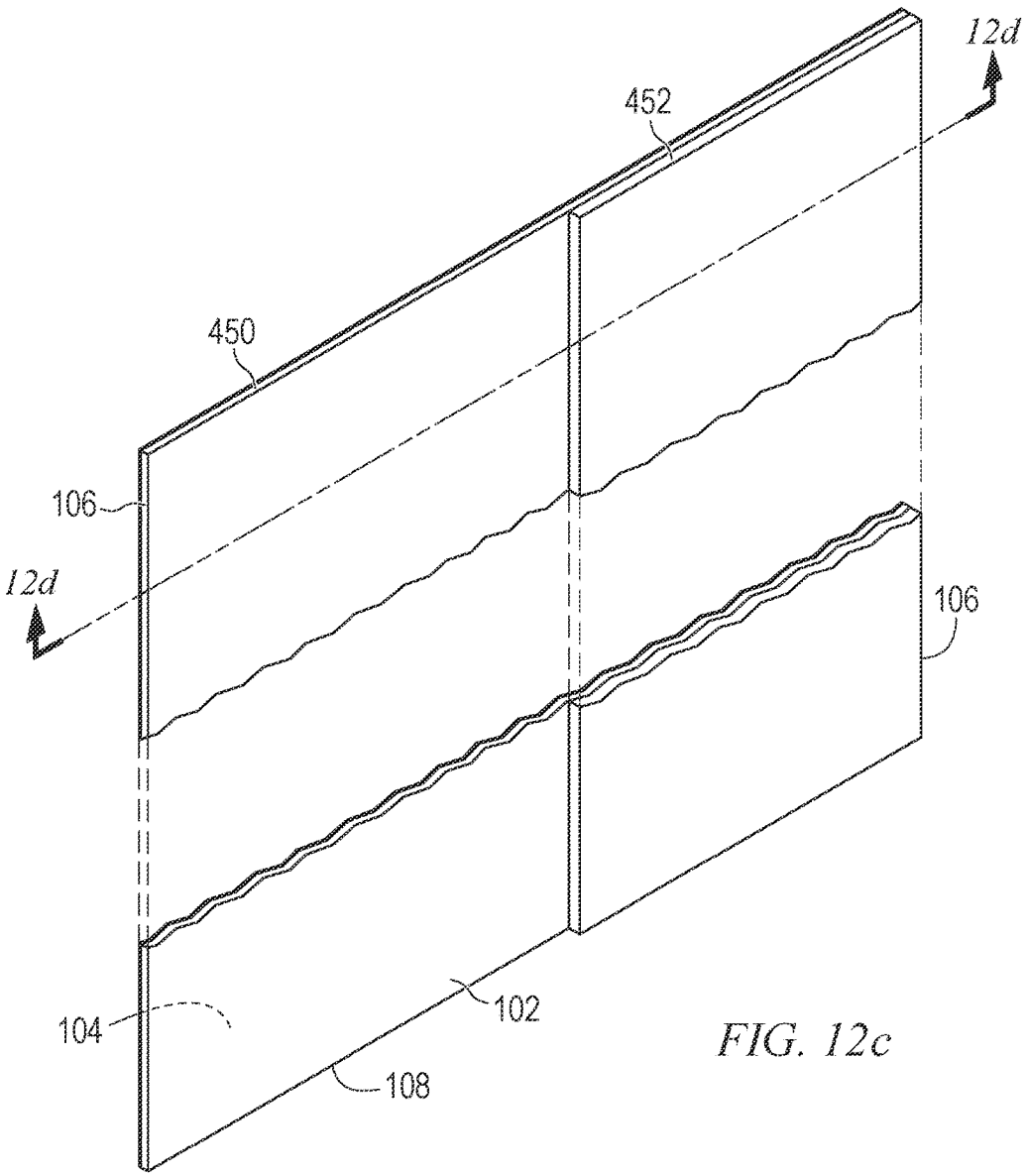

FIG. 12*c* shows backing 452 attached onto vinyl flooring 450. The surface of backing 452 to which adhesive 454 was applied is oriented toward vinyl flooring 450. In one embodiment, adhesive 454 is a type of adhesive or PVC cement that eats or melts the vinyl material of flooring 450 and backing 452 and then resolidifies to essentially weld the two pieces together. Any suitable adhesive is used in other embodiments. Backing 452 has a smaller width than vinyl flooring 450 so that only the portion of the vinyl flooring that will be grooved and folded has backing 452.

Figure 12D:
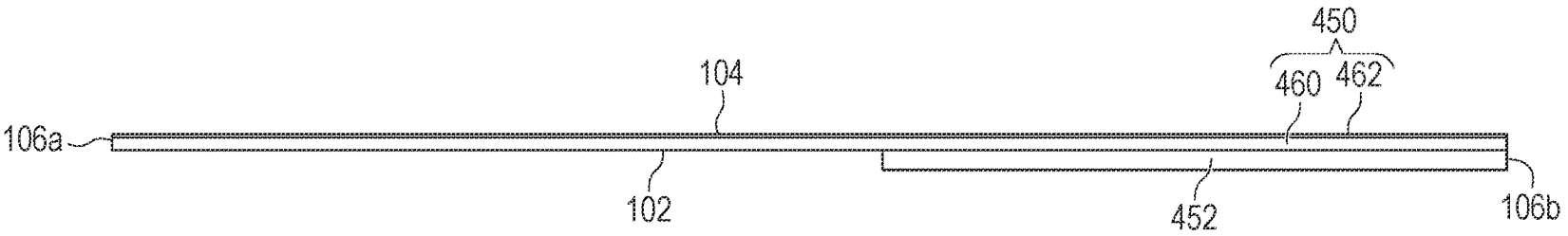

FIG. 12*d* shows a cross-section of vinyl flooring 450 with backing 452 attached. Vinyl flooring 450 typically has a vinyl substrate 460, an image layer, and clearcoat layer 462 applied over the image layer, similar to image layer 56 and clearcoat layer 58 above. In other embodiments, vinyl flooring is used that is just a vinyl substrate with a visual pattern embedded in or painted onto the vinyl material.

Figure 12E:
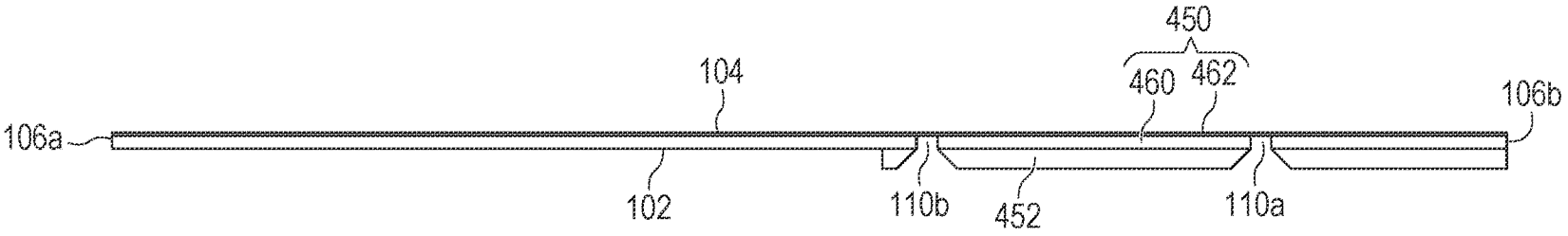
Figure 12F:
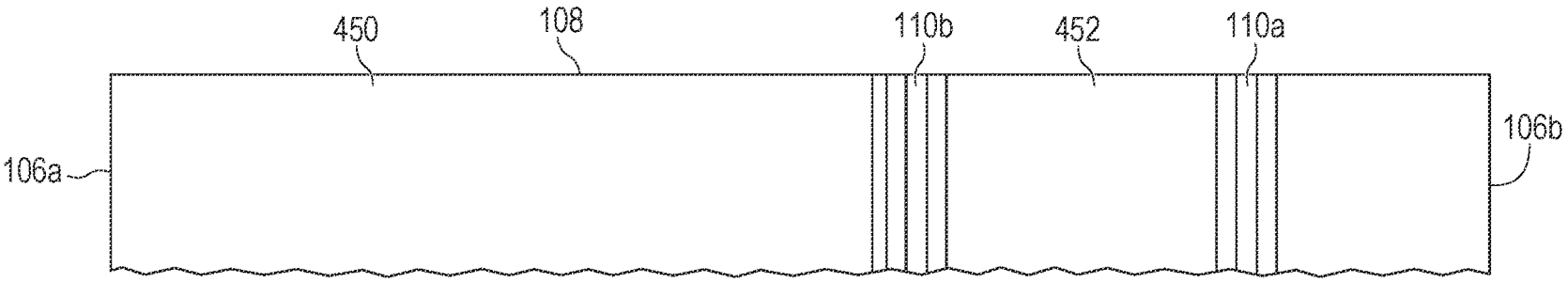
Figure 12G:
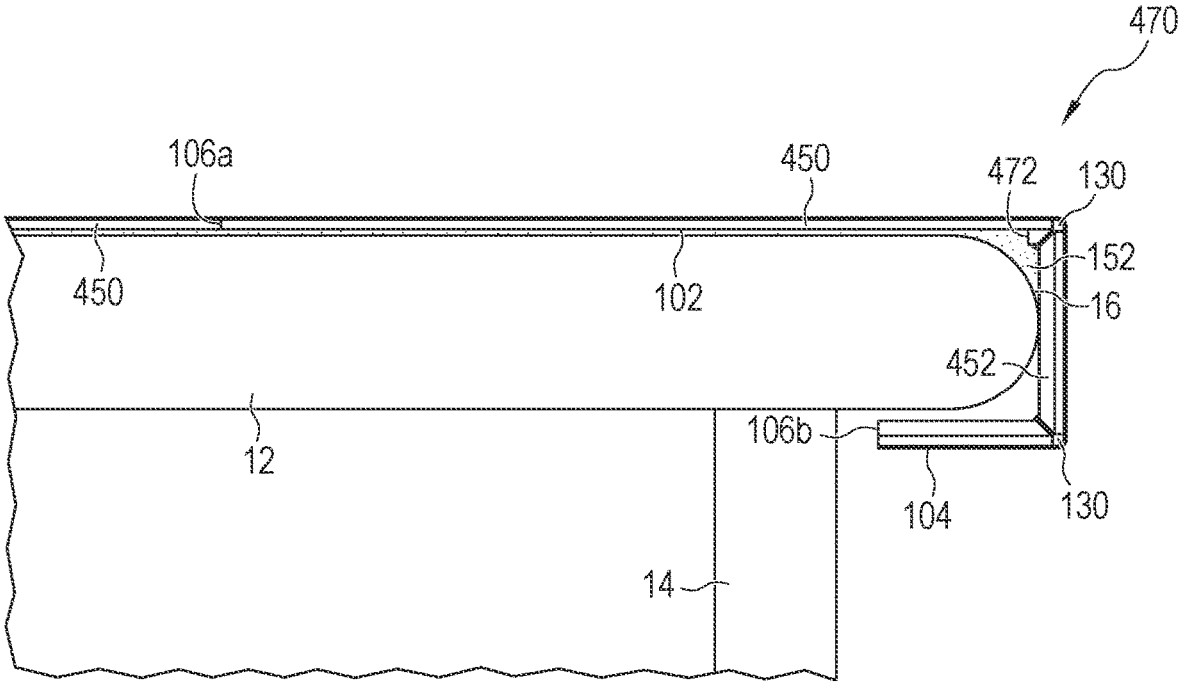

In FIG. 12*e*, beveled grooves 110*a* and 110*b* are formed as described above. Square grooves 180 or any other suitable groove profile is formed in other embodiments. Grooves 110 extend along the entire length of vinyl flooring 450 and backing 452. Grooves 110 are formed extending completely through backing 452 and into vinyl flooring 450 to a depth that is just to the image layer without extending through to clearcoat layer 462. A portion of vinyl substrate 460 remains at the bottoms of grooves 110 in other embodiments. Grooves 110 can also be formed only in backing 452 and not extending into vinyl flooring 450 in embodiments with especially thin vinyl flooring or other types of thin flooring. FIG. 12*f* shows vinyl flooring 450 and backing 452 from the bottom with grooves 110.

The portion of vinyl flooring 450 that has backing 452 attached is folded around grooves 110 and glued as described above to form a stair nose 470 in FIG. 12*g*. Stair nose 470 is attached to tread 12 by adhesive 152 or another suitable adhesive. A size of backing 462 is selected so that edge 472 running parallel to nose 16 does not contact tread 12 or nose 16. Therefore, vinyl flooring 450 of stair nose 470 lies flat on tread 12 like the next piece of flooring 450*a* that is not part of a stair nose. In some embodiments, backing 452 is cut short enough that edge 472 is coplanar with the underlying vertical section of the backing. Because only flooring 450 without backing 452 is placed on tread 12, the thickness and feel of the stair nose matches the rest of the surrounding vinyl flooring.

Figure 12H:
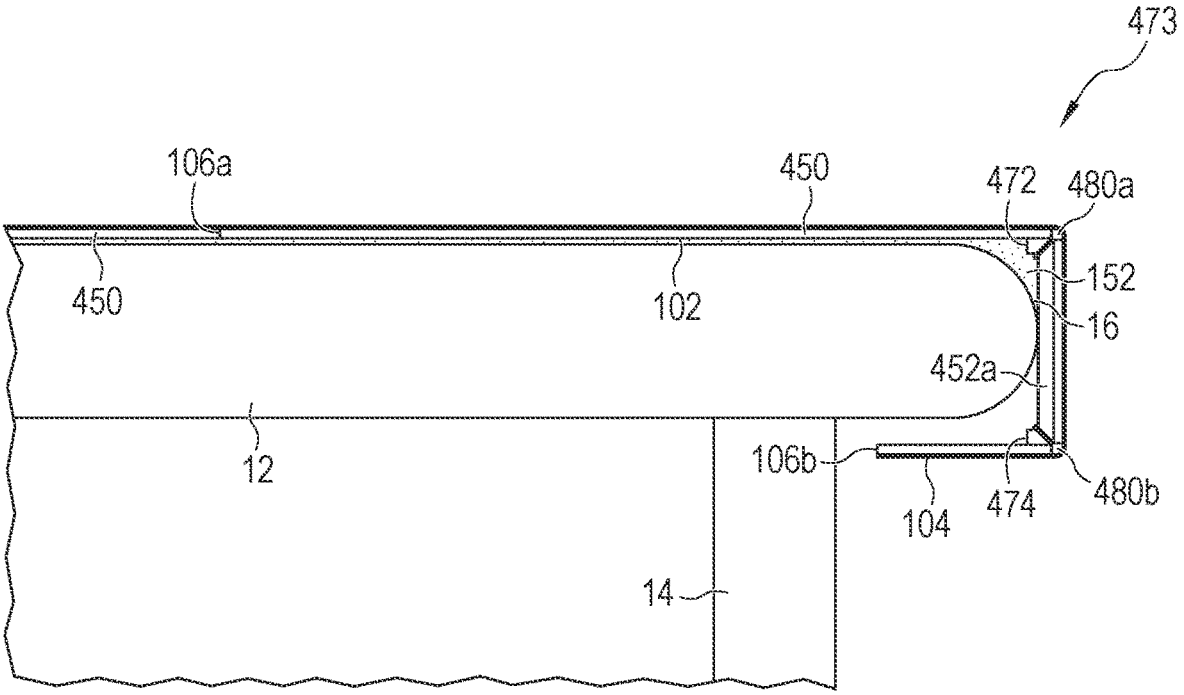

An edge of backing 452 does not necessarily need to align perfectly with an edge of vinyl flooring 450. FIG. 12*h* shows an embodiment where edge 474 opposite edge 472 is located inward from edge 106*b* of flooring 450. The portion of vinyl flooring 450 under tread 12 is not going to need to support significant weight during normal usage, so having the edge of the vinyl flooring floating without backing 452 is not going to be structurally problematic. In other embodiments, backing 452 is split into a separate piece per groove 110, such that each corner 480*a* and 480*b* has a separate piece of backing material.

Figure 13:
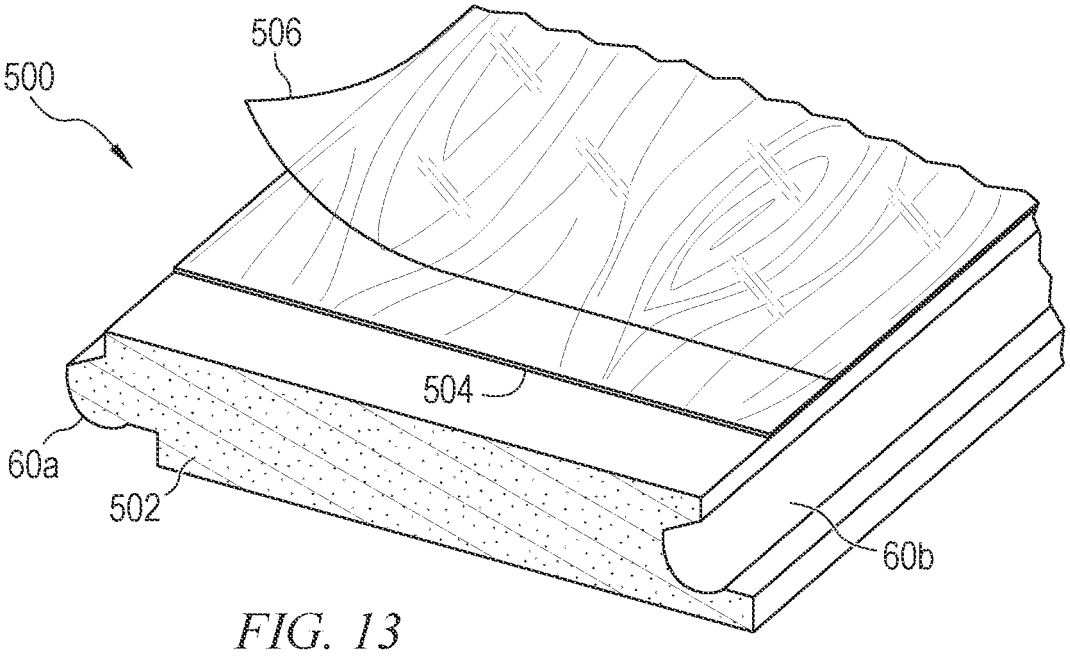
FIG. 13 illustrates a laminate flooring plank.

FIG. 13 shows laminate flooring 500. Laminate flooring 500 includes a wood base 502 topped with an image layer 504 and wear layer 506. Wood base 502 is typically a particleboard or fiberboard material, but solid or hard wood can also be used. Wood base 502 can also be other non-wood materials in some embodiments, e.g., plastic, metal, clay, tile, or any other suitable flooring material. Image layer 504 and wear layer 506 are fused to wood base 502 using a lamination process. In some embodiments, image layer 504 is laminated and wear layer 506 is sprayed on. Image layer 504 has a pattern printed thereon as desired for the look of a floor being installed, which can be wood grain, stone, or any other desired flooring design. Wear layer 506 is typically formed of aluminum oxide, but other suitable materials are used in other embodiments. Laminate flooring plank 500 optionally includes an integrated padding layer on the bottom of the plank, opposite image layer 504.

Laminate flooring 500 is manufactured in planks as described above and includes connectors 60 to link multiple planks together when installing the flooring. Unlike the previously described planks. Wood base 502 does not have significant flexibility. Forming grooves 110 in laminate flooring 500 would not be satisfactory due to wood base 502 not being flexible enough. If a portion of wood base 502 were left remaining at the bottom of each groove 110, the remaining wood base in the groove would break rather than curve as in the above embodiments. If wood base 502 were completely removed within groove 110, the remaining portions of image layer 504 and wear layer 506 would not be sufficient to holding together the portions of the wood base on either side of the groove.

Figure 14:
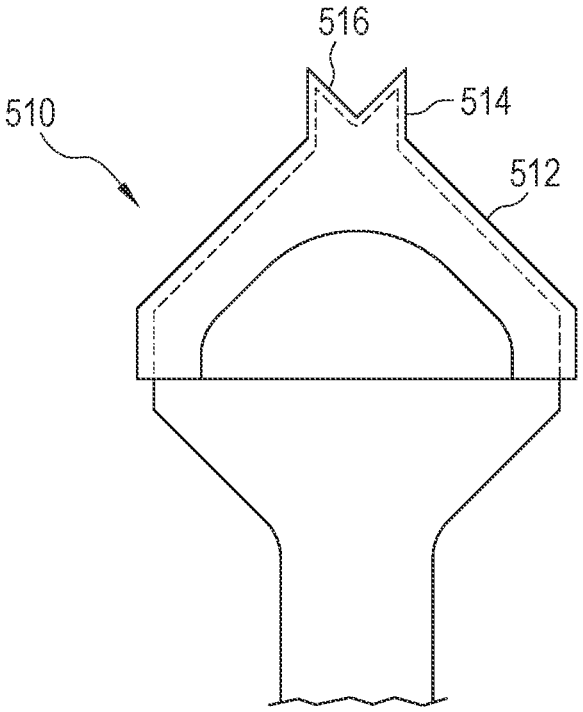
FIG. 14 illustrates a saw blade used to cut a groove for laminate flooring planks.

FIG. 14 illustrates the profile for a circular saw blade tooth 510 suitable for cutting grooves in laminate flooring 500 for the purposes of turning the laminate flooring into a stair nose. Tooth 510 includes 45-degree sloped side surfaces 512 and vertical side surfaces 514 similar to blades 210 and 220 above. Sloped surfaces 512 extend toward each other as the sloped surfaces get further from the center of the circular blade. Vertical surfaces 514 begin at the furthest point of sloped surfaces 512 from the center of the circular blade, where the sloped surfaces would otherwise meet each other.

Instead of having a flat top or outer surface as with blades 210 and 220, tooth 510 includes a triangular cutout 516 between vertical surfaces 514. Triangular cutout 516 has two surfaces with a 90-degree angle centered between the two vertical surfaces 514 to make tooth 510 as a whole symmetrical.

Figure 15C:
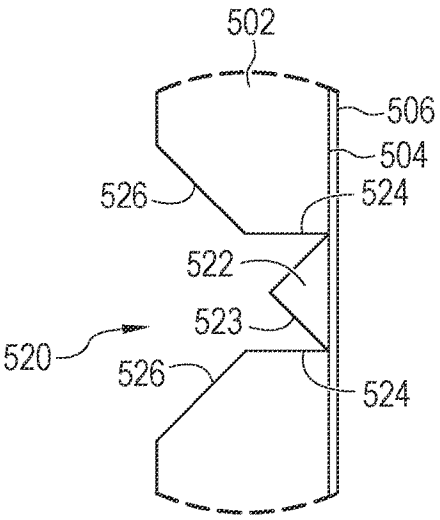
FIGS. 15*a*-15*c* illustrate a laminate flooring plank with grooves formed.
Figure 15B:
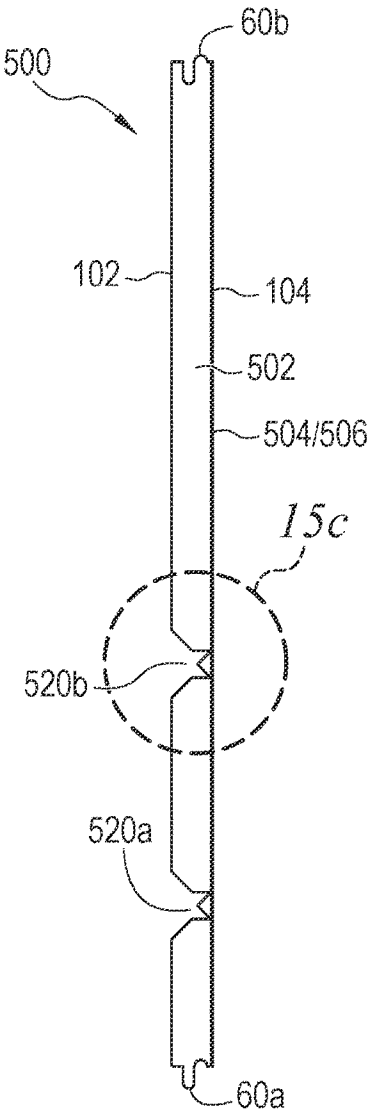
Figure 15A:
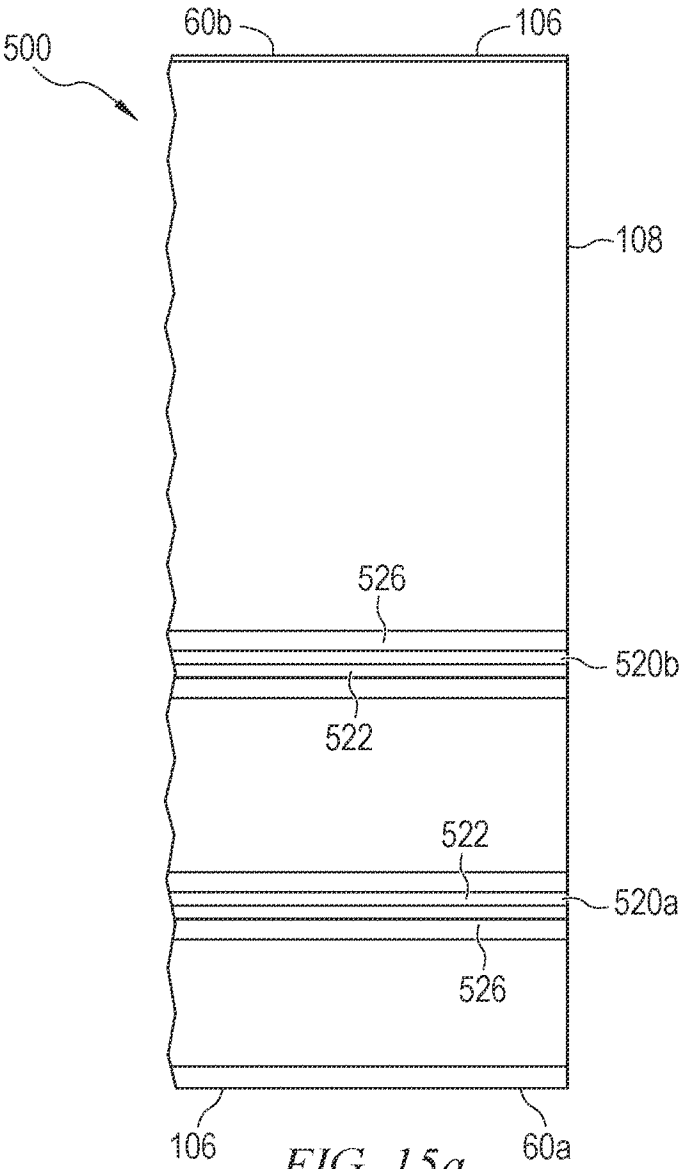

FIGS. 15*a*-15*c* illustrate a laminate plank 500 with two grooves 520 formed using a circular saw blade with teeth 510. FIG. 15*a* is a plan view, while FIG. 15*b* is a cross-sectional or end view of panel 500 with grooves 520. FIG. 15*c* shows details of groove 520 from the angle of FIG. 15*b*. A pair of grooves 520*a* and 520*b* are formed as with grooves 110 above to allow plank 500 to be folded along two parallel lines. Some embodiments only utilize a single groove 520, while other embodiments utilize more than two grooves. Sloped surfaces 526 in grooves 520 are cut by sloped surfaces 512 of tooth 510. Vertical surfaces 524 in groove 520 are cut by vertical surfaces 514 of tooth 510. Triangular cutout 516 results in a triangular portion 522 being left in the bottom of groove 520, including two inner sloped surfaces 523 that extend from the bottoms of vertical surfaces 524 to meet at a 90-degree angle in the center of groove 520.

Figure 16A:
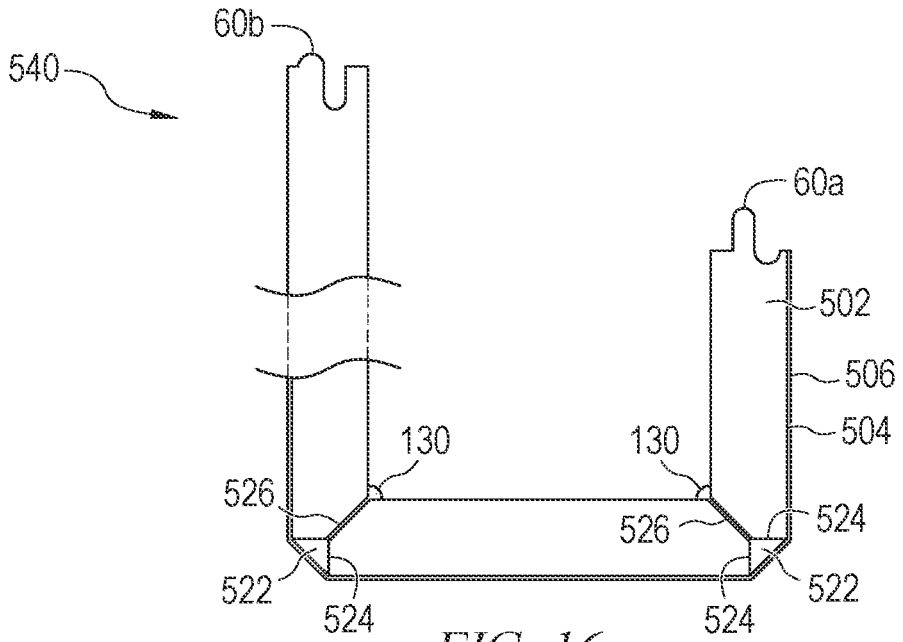
FIGS. 16*a* and 16*b* illustrate a laminate flooring plank converted into a stair nose.

Preferably, the depth of groove 520 is such that the bottom of the groove where vertical surfaces 524 meet inner sloped surfaces 523 is exactly cut through the entirety of wood base 502 without cutting into image layer 504 at all. This ideal allows plank 500 to fold across grooves 520 into the shape of a stair nose 540 shown in FIG. 16*a* without having to break any portion of wood base 502 to make the fold, and without cutting into image layer 504, which would compromise the strength of the image layer holding together the discrete portions of plank 500 created by cutting groove 520. Refraining from cutting into image layer 504 at all also reduces the likelihood that the image layer is visibly damaged from the viewpoint of top surface 104, which could hurt the aesthetic of the resulting stair nose after installation.

Of course, the ideal is not required for grooves 520 to successfully transform a laminate plank 500 into a stair nose 540. The process can withstand a small portion of wood base 502 remaining at the bottom of groove 520 having to be broken when plank 500 is folded into stair nose 500. Likewise, the process can still be successful if cutting groove 520 removes a portion of image layer 504. Cutting completely through image layer 504 and wear layer 506 presents a problem because triangular portion 522 is likely to separate from one or both of the adjacent portions of wood base 502. While the pieces could be glued back together and used as a stair nose, the aesthetics of the end product may be harmed.

Triangular portion 522 being left in the bottom of groove 520 physically supports image layer 504, which is relied upon to hold together triangular portion 522 and the sections of wood base 502 on either side of groove 520. Without triangular portion 522, handling plank 500 without ripping image layer 504 would be challenging. The amount of wood base 502 removed is enough to allow a thin line of image layer 504 to flex between vertical surfaces 524 and inner sloped surfaces 523 without relative angles between the portions of wood base 502 changing significantly.

Triangular portion 522 also keeps the portions of wood base 502 on either side of groove 520 properly aligned when folding plank 500 into stair nose 540. The outer sloped surfaces 526 are cut at 45-degree angles relative to top surface 104 so that when plank 500 is folded across groove 520 to a 90-degree angle the two sloped surfaces 526 meet and contact each other flat and parallel. In other embodiments, outer sloped surfaces 526 are formed asymmetrically but with angles that add up to 90 degrees so that the outer sloped surfaces are parallel when plank 500 is folded across groove 520 to a 90-degree angle. Other angles can be used in other embodiments where plank 500 is going to be folded to a non-right angle.

Likewise, inner sloped surfaces 523 are cut at a 45-degree angle so that, when plank 500 is folded across groove 520 to a 90-degree angle, vertical surfaces 526 lie flat on and parallel with sloped surfaces 523. Keeping triangular portion 522 in the bottom of groove 520 ensures that the portions of wood base 502 stay aligned and outer sloped surfaces 526 meet each other properly. Vertical surfaces 524 press against triangular portion 522, which has a 90-degree angle, thus aligning the adjacent portions of plank 500 at a 90-degree angle. As with outer sloped surfaces 526, triangular portion 522 does not need to be symmetrical and does not need to have a right-angle point in all embodiments.

Adhesive 130 is dispensed into groove 520 before folding plank 500, and cured after folding plank 500, as described above. The specific adhesive used may be different to adhere properly to the specific material of wood base 502. In some embodiments, the cuts for outer sloped surfaces 526 are slightly offset outward within groove 520 to leave a small gap between them when groove 520 is folded at a 90-degree angle, rather than the surfaces touching each other. The slight gap accommodates a thin layer of adhesive 130 between sloped surfaces 526.

Figure 16B:
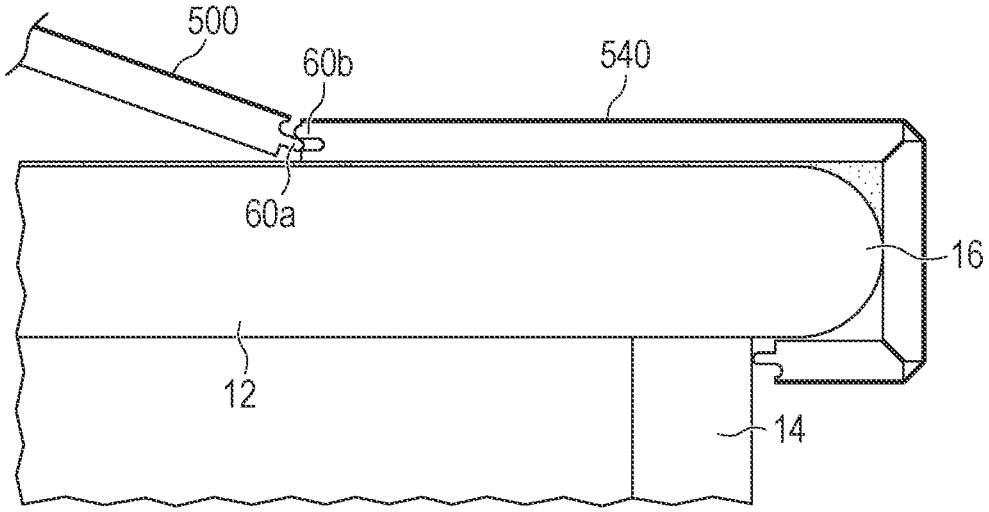

Once adhesive 130 is dried and cured as needed for the particular adhesive being used, stair nose 540 can be installed onto a stair as described above and illustrated in FIG. 16*b*. Additional planks 500 of laminate flooring that match stair nose 540 can be linked behind the stair nose via connectors 60 to cover any remaining portion of a stair tread or to cover the floor at the top of the stairs. Planks 500 can also be manufactured to be larger than a stair step so that the resulting stair nose 540 can be cut to the size of a step without needing to attach additional planks 500 during installation. Groove 520 with triangular portion 522 being left in the groove allows flooring planks without a flexible base material to be turned into a stair nose so that the stairs perfectly match surrounding floors.

While one or more embodiments of the present invention have been illustrated in detail, the skilled artisan will appreciate that modifications and adaptations to those embodiments may be made without departing from the scope of the present invention as set forth in the following claims.

What is claimed:

1. A stair nose molding, comprising:

a laminate flooring plank including, a wood base, an image layer disposed on the wood base, a wear layer disposed over the image layer, wherein the image layer and wear layer are fused to the wood base using a lamination process, a first groove formed in the laminate flooring plank, wherein the first groove includes a first triangular portion of the laminate flooring plank remaining in the bottom of the first groove, a second groove formed in the laminate flooring plank parallel to the first groove, wherein the second groove includes a second triangular portion of the laminate flooring plank remaining in the bottom of the second groove, and wherein a distance between the first groove and second groove is configured to be greater than a thickness of a stair tread; and an adhesive disposed in the first groove, wherein the laminate flooring plank is folded to an approximately 90-degree angle at the first groove.

2. The stair nose molding of claim 1, wherein a first surface of the laminate flooring plank on a first side of the first groove is oriented parallel to a second surface of the laminate flooring plank on a second side of the first groove.

3. The stair nose molding of claim 1, wherein a first surface of the laminate flooring plank is oriented parallel to a surface of the first triangular portion.

4. The stair nose molding of claim 1, wherein the laminate flooring plank includes an inflexible base material and an image layer disposed over the inflexible base material.

5. The stair nose molding of claim 1, wherein the first groove extends completely through the inflexible base material without extending completely through the image layer.

6. The stair nose molding of claim 5, wherein the first groove extends completely through the inflexible base material on two sides of the first triangular portion.

7. The stair nose molding of claim 1, further including a stair nose with a first portion of the laminate flooring plank disposed on a top surface of the stair nose and a second portion of the laminate flooring plank disposed under the stair nose.

8. A molding, comprising:

a piece of flooring;

a first groove formed in the piece of flooring, wherein a first triangular portion of the piece of flooring remains in the first groove; and a second groove formed in the piece of flooring parallel to the first groove, wherein a second triangular portion of the piece of flooring remains in the second groove, and wherein a distance between the first groove and second groove is configured to be greater than a thickness of a stair tread.

9. The molding of claim 8, wherein the piece of flooring is folded across the first groove and second groove.

10. The molding of claim 8, wherein a first surface of the piece of flooring on a first side of the first groove is glued to a second surface of the piece of flooring on a second side of the first groove.

11. The molding of claim 8, wherein a first surface of the piece of flooring is glued to a surface of the first triangular portion.

12. The molding of claim 8, wherein the piece of flooring includes an inflexible base material and an image layer disposed over the inflexible base material.

13. The molding of claim 12, wherein the first groove extends completely through the inflexible base material without extending completely through the image layer.

14. The molding of claim 13, wherein the first groove extends completely through the inflexible base material on two sides of the first triangular portion.

* * * * *